US008002488B2

(12) United States Patent
Cheng

(10) Patent No.: US 8,002,488 B2
(45) Date of Patent: Aug. 23, 2011

(54) SOFT CLOSE RING BINDER MECHANISM

(75) Inventor: Hung Yu Cheng, Hong Kong (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 1898 days.

(21) Appl. No.: 10/870,165

(22) Filed: Jun. 17, 2004

(65) Prior Publication Data

US 2005/0201818 A1 Sep. 15, 2005

Related U.S. Application Data

(60) Provisional application No. 60/553,155, filed on Mar. 15, 2004.

(51) Int. Cl.
*B42F 3/04* (2006.01)

(52) U.S. Cl. ..... 402/35

(58) Field of Classification Search ..... 402/19, 402/20, 26, 31, 35, 36, 37, 38, 39, 41, 42, 402/70, 73, 80 R, 502
See application file for complete search history.

(56) References Cited

U.S. PATENT DOCUMENTS

| | | | | |
|---|---|---|---|---|
| 566,717 | A | 8/1896 | Krah | |
| 651,254 | A | 6/1900 | Krah | |
| 683,019 | A | 9/1901 | Buchanan | |
| 790,382 | A | 5/1905 | McBride | |
| 854,074 | A | 5/1907 | Bryant | |
| 857,377 | A | 6/1907 | Baker | |
| 974,831 | A | 11/1910 | Scherzinger | |
| 1,011,391 | A * | 12/1911 | Sturgis | 402/37 |
| 1,163,179 | A | 12/1915 | Schade, Jr. | |
| 1,168,260 | A | 1/1916 | Albrecht | |
| 1,398,034 | A | 11/1921 | Mero | |
| 1,398,388 | A | 11/1921 | Murphy | |

(Continued)

FOREIGN PATENT DOCUMENTS

DE 10119121 A1 10/2001

(Continued)

OTHER PUBLICATIONS

Kokuyo Lock Ring Mechanism with description, two instruction sheets, and nine photographs, undated but admitted as prior art, 12 pgs.

(Continued)

*Primary Examiner* — Dana Ross
*Assistant Examiner* — Matthew G Katcoff
(74) *Attorney, Agent, or Firm* — Senniger Powers LLP

(57) ABSTRACT

A ring binder mechanism that retains loose-leaf pages and has ring members that do not snap together when they close and that easily open and close as pages accumulate. The mechanism includes a housing that supports two hinge plates for loose pivoting motion, moving the ring members apart or together. The mechanism further includes an actuating lever pivotally mounted on the housing. The lever moves a travel bar and locking elements for controllably pivoting the hinge plates, and therefore controllably moving the ring members apart and together. In particular, the locking elements cam the hinge plates to softly close the ring members. When the ring members are apart, the locking elements register with openings in at least one of the hinge plates. When the ring members are together, the locking elements are out of registration with the openings, blocking the hinge plates from pivoting to separate the ring members.

20 Claims, 21 Drawing Sheets

U.S. PATENT DOCUMENTS 1,733,548 A 10/1929 Martin
1,733,894 A 10/1929 Martin
1,787,957 A 1/1931 Schade
1,822,669 A 9/1931 Schade
1,857,291 A * 5/1932 Trussell ..... 402/38
1,953,981 A 4/1934 Trussell
1,991,362 A 2/1935 Krag
1,996,463 A 4/1935 Dawson et al.
2,004,570 A 6/1935 Dawson
2,013,416 A 9/1935 McClure
2,024,461 A 12/1935 Lotter
2,067,846 A 1/1937 Cooper
2,075,766 A 3/1937 Rand
2,081,372 A 5/1937 Thomas
2,089,211 A 8/1937 Krag
2,096,944 A 10/1937 Unger et al.
2,103,307 A 12/1937 Unger
2,105,235 A 1/1938 Schade
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,062 A 4/1941 Tallmadge
2,239,121 A 4/1941 St. Louis et al.
2,251,878 A 8/1941 Hanna
2,252,422 A 8/1941 Unger
2,260,929 A 10/1941 Bloore
2,288,189 A 6/1942 Guinane
2,304,716 A 12/1942 Supin
2,311,492 A 2/1943 Unger
2,322,595 A 6/1943 Schade
2,338,011 A 12/1943 Schade
2,421,799 A 6/1947 Martin
2,528,866 A 11/1950 Dawson, Jr.
2,543,866 A 3/1951 Panfil
2,552,076 A 5/1951 Wedge
2,612,169 A * 9/1952 Segal ..... 402/38
2,789,561 A 4/1957 Bonn
2,865,377 A 12/1958 Schroer et al.
2,871,711 A 2/1959 Stark
2,891,553 A 6/1959 Acton
2,894,513 A 7/1959 Gempe
3,077,888 A 2/1963 Thieme
3,098,489 A 7/1963 Vernon
3,098,490 A 7/1963 Wance
3,101,719 A 8/1963 Vernon
3,104,667 A 9/1963 Mintz
3,149,636 A 9/1964 Rankin
3,190,293 A 6/1965 Schneider et al.
3,205,894 A 9/1965 Rankin
3,205,895 A 9/1965 Johnson
3,255,759 A 6/1966 Dennis
3,348,550 A 10/1967 Wolf et al.
3,718,402 A 2/1973 Schade
3,748,051 A 7/1973 Frank
3,884,586 A 5/1975 Michaelis et al.
3,954,343 A 5/1976 Thomsen
3,993,374 A 11/1976 Schudy et al.
4,127,340 A 11/1978 Almgren
4,130,368 A 12/1978 Jacoby et al.
4,352,582 A 10/1982 Eliasson
4,486,112 A 12/1984 Cummins
4,522,526 A 6/1985 Lozfau
4,566,817 A 1/1986 Barrett, Jr.
4,571,108 A 2/1986 Vogl
4,696,595 A 9/1987 Pinkney
4,798,491 A 1/1989 Lässle
4,813,803 A 3/1989 Gross
4,815,882 A 3/1989 Ohminato
4,886,390 A 12/1989 Silence
4,919,557 A 4/1990 Podosek
5,067,840 A 11/1991 Cooper
5,116,157 A 5/1992 Gillum et al.
5,180,247 A 1/1993 Yu
5,255,991 A 10/1993 Sparkes
5,286,128 A 2/1994 Gillum
5,332,327 A 7/1994 Gillum
5,346,325 A 9/1994 Yamanoi
5,354,142 A 10/1994 Yu
5,368,407 A 11/1994 Law
5,378,073 A 1/1995 Law
5,393,155 A 2/1995 Ng
5,393,156 A 2/1995 Mullin et al.
5,476,335 A 12/1995 Whaley
5,524,997 A 6/1996 von Rohrscheidt
5,577,852 A 11/1996 To
5,634,666 A 6/1997 Lee
5,651,628 A 7/1997 Bankes
5,660,490 A * 8/1997 Warrington ..... 402/36
5,692,847 A 12/1997 Zane et al.
5,692,848 A 12/1997 Wada
5,718,529 A 2/1998 Chan
5,782,569 A 7/1998 Mullin et al.
5,788,392 A 8/1998 Cheung
5,807,006 A 9/1998 Cheung
5,810,499 A 9/1998 Law
5,816,729 A 10/1998 Whaley
5,836,709 A 11/1998 Cheung
5,868,513 A 2/1999 Law
5,879,097 A 3/1999 Cheng
5,882,135 A 3/1999 Ko
5,895,164 A 4/1999 Wu
5,924,811 A 7/1999 To
5,957,611 A 9/1999 Whaley
5,975,785 A 11/1999 Chan
6,036,394 A 3/2000 Cheng
6,142,697 A 11/2000 Williams
6,146,042 A 11/2000 To
6,155,737 A 12/2000 Whaley
6,203,229 B1 3/2001 Coerver
6,206,601 B1 3/2001 Ko
6,217,247 B1 4/2001 Ng
6,270,279 B1 8/2001 Whaley
6,276,862 B1 * 8/2001 Snyder et al. ..... 402/40
6,293,722 B1 9/2001 Holbrook et al.
6,364,558 B1 4/2002 To
6,371,678 B1 4/2002 Chizmar
6,467,984 B1 10/2002 To
6,474,897 B1 11/2002 To
6,533,486 B1 3/2003 To
6,749,357 B2 * 6/2004 Cheng ..... 402/19
6,758,621 B2 7/2004 To
6,821,045 B2 11/2004 Whaley
6,840,695 B2 * 1/2005 Horn ..... 402/31
6,916,134 B2 7/2005 Wong
7,296,946 B2 * 11/2007 Cheng et al. ..... 402/19
2002/0122687 A1 9/2002 Horn
2003/0044221 A1 3/2003 To
2003/0103797 A1 6/2003 Cheng
2003/0103798 A1 6/2003 Cheng et al.
2003/0123923 A1 7/2003 Koike et al.
2005/0013654 A1 1/2005 Cheng et al.
2005/0201817 A1 9/2005 Cheng
2005/0201818 A1 9/2005 Cheng
2005/0201819 A1 9/2005 Cheng
2005/0201820 A1 9/2005 Ng
2005/0207826 A1 9/2005 Cheng
2005/0214064 A1 9/2005 Ng
2005/0232689 A1 10/2005 Cheng
2006/0008318 A1 1/2006 Ng
2006/0056906 A1 3/2006 Horn
2006/0088365 A1 * 4/2006 Whaley ..... 402/38
2006/0147253 A1 7/2006 Cheng
2006/0147254 A1 7/2006 Cheng
2006/0147255 A1 7/2006 Cheng
2006/0153628 A1 7/2006 Tanaka
2006/0153629 A1 7/2006 Cheng
2006/0216107 A1 9/2006 Lin
2006/0228164 A1 10/2006 Horn
2006/0251467 A1 11/2006 Cheng
2006/0251468 A1 11/2006 Cheng
2007/0086836 A1 4/2007 Cheng

FOREIGN PATENT DOCUMENTS

EP 1316438 A1 4/2003
EP 1323545 A2 7/2003

| | | | |
|---|---|---|---|
| EP | 1431065 | A2 | 6/2004 |
| FR | 1 336 765 | | 7/1962 |
| FR | 1336765 | | 9/1963 |
| FR | 1 346 864 | A | 12/1963 |
| FR | 1346864 | | 12/1963 |
| FR | 2221924 | | 10/1974 |
| FR | 2 238 332 | A | 2/1975 |
| FR | 2238332 | | 2/1975 |
| GB | 868724 | | 5/1961 |
| GB | 906279 | | 9/1962 |
| GB | 952536 | | 3/1964 |
| GB | 2231536 | A | 11/1990 |
| GB | 2251215 | A | 7/1992 |
| GB | 2275023 | A | 8/1994 |
| GB | 2 292 343 | A | 2/1996 |
| GB | 2292343 | A | 2/1996 |
| GB | 2387815 | A | 10/2003 |
| JP | 59-79379 | | 5/1984 |
| JP | 61-18880 | | 2/1986 |
| JP | 1299095 | | 12/1989 |
| JP | 01299095 | A | 12/1989 |
| JP | 234289 | | 3/1990 |
| JP | 4-120085 | | 10/1992 |
| JP | 10217662 | A | 8/1998 |
| JP | 2004098417 | A | 4/2004 |
| WO | 0119620 | A1 | 3/2001 |
| WO | WO 01/19620 | A1 | 3/2001 |
| WO | 0181099 | A1 | 11/2001 |

OTHER PUBLICATIONS

Nov. 23, 2007 Office Action and reference cited by Examiner in related U.S. Appl. No. 10/870,801, 12 pages.

Office Action dated May 30, 2008 from related U.S. Appl. No. 11/080,710, 10 pgs.

Office Action dated Aug. 7, 2008 from related U.S. Appl. No. 10/905,031, 11 pgs.

WordReference.com English Dictionary definition for "translation"; Oct. 2, 2008; http://www.wordreference.com/definition/translation; 1 pg.

Advisory Action dated Oct. 9, 2008 from related U.S. Appl. No. 10/870,801, 3 pgs.

* cited by examiner

SOFT CLOSE RING BINDER MECHANISM

CROSS-REFERENCE TO RELATED APPLICATION

This application claims the benefit of U.S. Provisional Application No. 60/553,155, filed Mar. 15, 2004, the entire text of which is hereby incorporated by reference.

BACKGROUND OF THE INVENTION

This invention relates to a ring binder mechanism for retaining loose-leaf pages, and in particular it relates to an improved mechanism for reducing snapping motion of ring members as they close and for securely locking closed ring members together.

As is known in the art, a typical ring binder mechanism retains loose-leaf pages, such as hole-punched papers, in a file or notebook. It generally features multiple rings each including two half ring members capable of selectively opening to add or remove papers, or selectively closing to retain papers and allow them to move along the rings. The ring members mount on two adjacent hinge plates that join together about a pivot axis for pivoting movement within an elongated housing. The housing loosely holds the hinge plates so they may pivot relative to the housing. The undeformed housing is slightly narrower than the joined hinge plates when the hinge plates are in a coplanar position (180°). So as the hinge plates pivot through this position, they deform the resilient housing and cause a spring force in the housing, urging the hinge plates to pivot away from the coplanar position either opening or closing the ring members. Thus, when the ring members are closed, this spring force resists hinge plate movement and clamps the ring members together. Similarly, when the ring members are open, the spring force holds them apart. An operator may typically overcome this force by manually pulling the ring members apart or pushing them together. In addition, in some mechanisms the operator may move a lever located at one or both ends of the mechanism for moving the hinge plates through the coplanar position to open or close the ring members (in addition to manually pulling the ring members apart or pushing them together).

One drawback to these typical ring binder mechanisms is that when the ring members close, the housing's spring force snaps them together rapidly and with a force that might cause fingers to be pinched between the ring members. The substantial spring force required to keep the ring members closed also makes pivoting the hinge plates through the coplanar position difficult, making it hard to both open and close the ring members. Another drawback is that when the ring members are closed, they do not positively lock together. So if the mechanism accidentally drops, the ring members may unintentionally open. Still another drawback is that over time the housing may begin to permanently deform, reducing its ability to uniformly clamp the ring members together and possibly causing uneven movements or gaps between closed ring members.

To address these concerns, some ring binder mechanisms include a control slide directly attached to the lever. These control slides have inclined cam surfaces that project through openings in the hinge plates for rigidly controlling the hinge plates' pivoting motion both when opening and closing the ring members. Examples of these types of mechanisms are shown in U.S. Pat. Nos. 4,566,817, 4,571,108, and 6,276,862 and in U.K. Pat. No. 2,292,343. Some of these cam surfaces include a stop for blocking the hinge plates' pivoting motion when the ring members are closed, locking the closed ring members together.

But these mechanisms still have several drawbacks, including that when the ring members close the housing's spring force may still snap them together. The spring force may also still make both opening and closing the ring members difficult. Furthermore, the control slides in these mechanisms, specifically the inclined cam surfaces and stops, are complexly shaped and can be difficult and time consuming to fabricate. Also, since the control slides directly bias the hinge plates, they are usually relatively wide and may need to be constructed of a large gauge metal to withstand forces associated with repeated use (i.e., repeatedly biasing the hinge plates to pivot). Therefore, the openings in the hinge plates receiving these control slides may also be relatively wide, possibly weakening the hinge plates so that they too must be made of a large gauge metal. These uses of large gauge metal may make mass production more costly.

Other ring binder mechanisms attempt to address the issues of avoiding snapping motion of the ring members and positively locking the ring members in the closed position. For instance, some mechanisms arrange the hinge plates so that they never pass through the coplanar position in their pivoting motion. As a result of avoiding the coplanar position of the hinge plates, the ring members do not violently snap together upon closing. However, a closing force applied to the ring members is relatively weak so that it is necessary to provide a separate locking device to keep the ring members closed. One example of this type of ring mechanism is shown in U.S. Pat. No. 5,660,490. Still another solution is to arrange the hinge plates and housing so that the hinge plates are only weakly biased by the housing. This may be accomplished by adding a separate wire form spring to the underside of the hinge plates to provide a bias for pivoting the hinge plates to a position in which the ring members are open. An example of this ring binder mechanism construction is shown in U.S. Pat. Appl. Publ. No. 2003/0123923 to Koike, et al. In these types of mechanisms, the ends of the ring members are formed with hooks that are engaged upon closing to hold the ring members in the closed position. It requires some dexterity to manipulate the ring members to engage and disengage them. The manipulation becomes even more difficult if the ring members are filled with loose-leaf pages. Further, the hooks are more susceptible to forces that may unintentionally open the ring binder. Moreover, ring binder mechanisms having multiple ring members requiring simultaneous engagement or disengagement of hooks may make operation more awkward and difficult.

Consequently, there is a need for a ring binder mechanism that securely locks for retaining loose-leaf pages but has ring members that easily open and close as pages accumulate and do not snap together when the ring members close. The present invention is directed to such a ring binder mechanism.

SUMMARY OF THE INVENTION

The present invention provides a ring binder mechanism having ring members that easily open and close as pages accumulate and that securely lock together preventing unintentional openings. It also provides a mechanism that reduces the snapping motion of the ring members as they close. A ring binder mechanism according to the present invention retains loose-leaf pages. The mechanism generally comprises a housing, which has longitudinal ends, and hinge plates, which are supported by the housing for pivoting motion about a pivot axis relative to the housing. The mechanism also comprises rings capable of holding the loose-leaf pages. Each ring includes two ring members. A first ring member is mounted on a first hinge plate and can move therewith relative to a second ring member. In a closed position, the two ring members form a substantially continuous, closed loop for allowing loose-leaf pages retained by the rings to be moved along the rings from one ring member to the other. In an open position, the two ring members form a discontinuous, open loop for adding or removing loose-leaf pages from the rings. The mechanism further comprises a travel bar and a locking element that are movable in translation relative to both the housing and the hinge plates. The travel bar moves in translation generally lengthwise of the housing. In this mechanism, the locking element produces the hinge plates' pivoting motion when it moves from a position that is in registration with an opening in at least one of the hinge plates to a position that is out of registration with the opening. But the locking element does not produce the pivoting motion when it moves from a position that is out of registration with the opening to one that is in registration with the opening. Furthermore, the mechanism comprises an actuating lever pivotally connected to the housing for moving the travel bar in translation. As the lever pivots it does not engage the hinge plates.

In another aspect, a ring binder mechanism according to the present invention retains loose-leaf pages. The mechanism generally comprises a housing, which has longitudinal ends, and hinge plates, which are supported by the housing for pivoting motion about a pivot axis relative to the housing. The mechanism also comprises rings capable of holding the loose-leaf pages. Each ring includes two ring members. A first ring member is mounted on a first hinge plate and can move therewith relative to a second ring member. In a closed position, the two ring members form a substantially continuous, closed loop for allowing loose-leaf pages retained by the rings to be moved along the rings from one ring member to the other. In an open position, the two ring members form a discontinuous, open loop for adding or removing loose-leaf pages from the rings. The mechanism further comprises a travel bar and a locking element that are movable in translation relative to both the housing and the hinge plates. The travel bar moves in translation generally lengthwise of the housing. In this mechanism, the locking element is in a position in registration with an opening in at least one of the hinge plates when the ring members are in the open position. And it is in a position out of registration with the opening when the ring members are in the closed position, thereby blocking the hinge plates' pivoting motion. Furthermore, the mechanism comprises a spring for producing the hinge plates' pivoting motion when the locking element moves to the position that is in registration with the opening.

In yet a further aspect, a ring binder mechanism according to the present invention retains loose-leaf pages. The mechanism generally comprises a housing, which has a longitudinal axis, and hinge plates, which are supported by the housing for pivoting motion about a pivot axis relative to the housing. The mechanism also comprises rings capable of holding the loose-leaf pages. Each ring includes two ring members. A first ring member is mounted on a first hinge plate and can move therewith relative to a second ring member. In a closed position, the two ring members form a substantially continuous, closed loop for allowing loose-leaf pages retained by the rings to be moved along the rings from one ring member to the other. In an open position, the two ring members form a discontinuous, open loop for adding or removing loose-leaf pages from the rings. The mechanism further comprises a travel bar and a locking element that are movable in translation relative to both the housing and the hinge plates. The travel bar moves in translation generally lengthwise of the housing. In this mechanism, the locking element is in a position in registration with an opening in at least one of the hinge plates when the ring members are in the open position. And it is in a position out of registration with the opening when the ring members are in the closed position, thereby blocking the hinge plates' pivoting motion. Furthermore, in this mechanism the hinge plates are supported by the housing such that an angle formed by the hinge plates' exterior surfaces never passes through 180° during the hinge plates' pivoting motion.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE INVENTION

This application contains subject matter in common with co-assigned, co-pending patent applications Ser. No. 10/870, 801 filed simultaneously herewith for a Ready Lock Ring Binder Mechanism and Ser. No. 10/870,168 filed simultaneously herewith for a Positive Lock Ring Binder Mechanism, the entire texts of which are hereby incorporated by reference.

Figure 1:
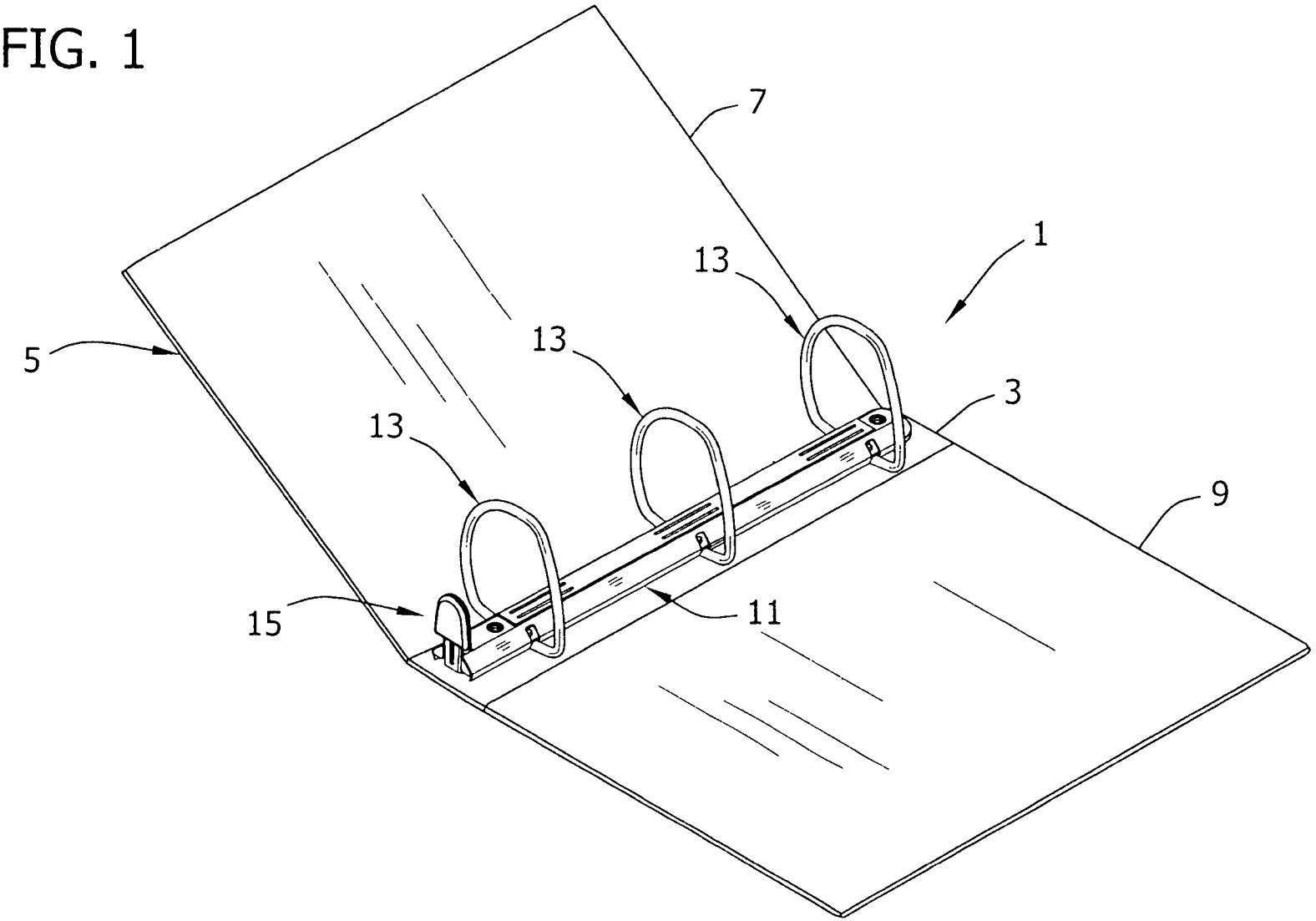
FIG. 1 is a perspective of a notebook incorporating a ring binder mechanism of the present invention according to a first embodiment.

Referring now to the drawings of the present invention, FIG. 1 shows a first embodiment of a ring binder mechanism of the present invention capable of retaining loose-leaf pages (not shown). The mechanism is generally designated by reference numeral 1 and is shown mounted on a spine 3 of a notebook 5 having a front cover 7 and a back cover 9 hingedly attached to the spine 3. The front and back covers 7, 9 move to selectively cover or expose retained pages. Ring binder mechanisms mounted on surfaces other than a notebook, however, do not depart from the scope of this invention. The mechanism 1 of this embodiment generally includes a housing 11, three rings (each generally indicated at 13), and a control structure (generally indicated at 15). As shown in FIGS. 2A-3B, the housing 11 supports both the rings 13 and the control structure 15 for either closing the mechanism 1 to retain pages on the rings 13 or opening it to load pages on the rings 13. As will be described hereinafter, the control structure 15 can either directly close and lock the mechanism 1 or it can allow wire form springs 17 attached to undersides of hinge plates 19, 21 to open the mechanism 1.

Figure 4:
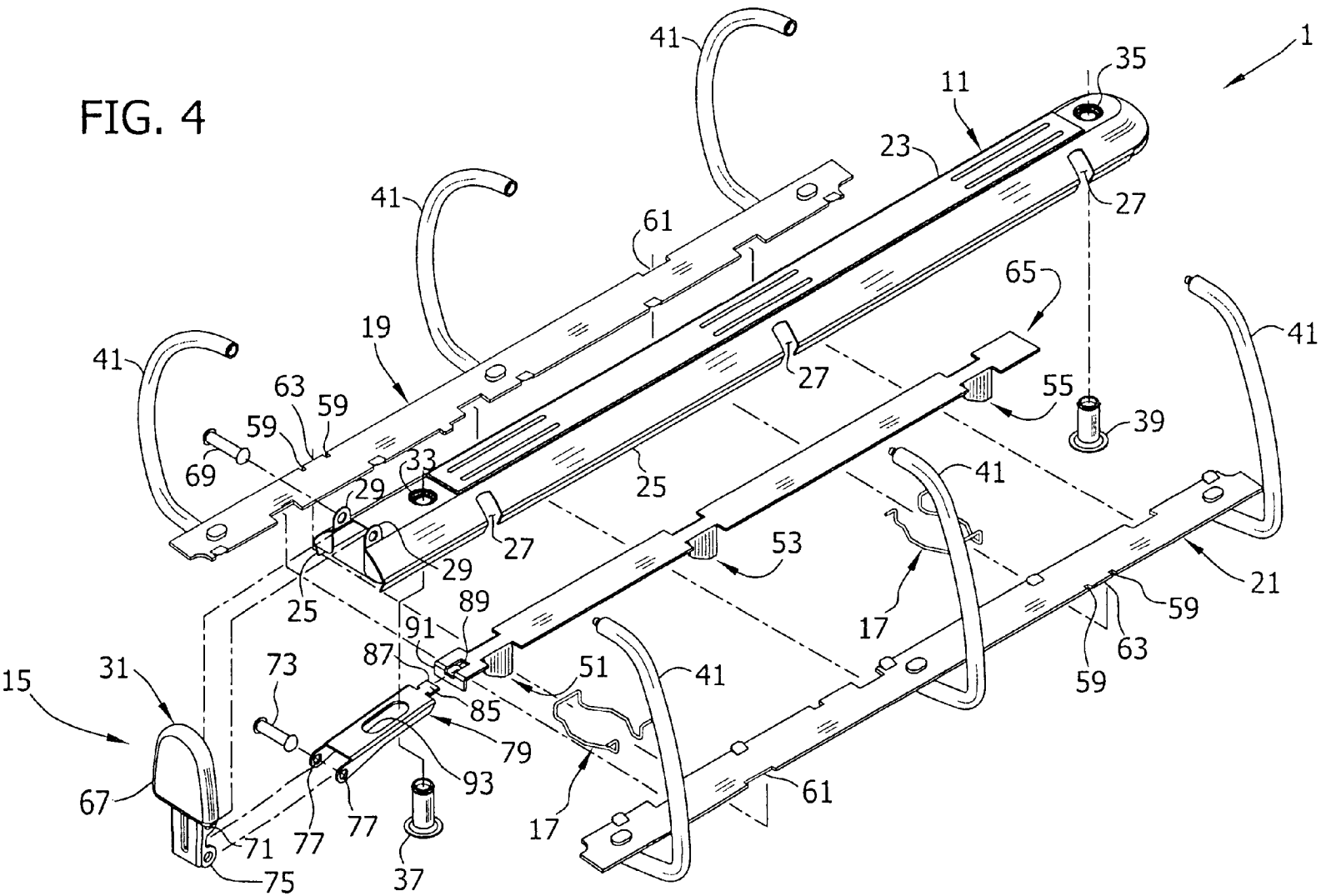
FIG. 4 is an exploded perspective of the mechanism.

Referring to FIG. 4, the housing 11 is elongate and has a symmetrical, roughly arch-shaped cross section with a raised plateau 23 at its center. The housing 11 is made of metal, but may be also made of other suitable material that is sufficiently rigid to provide a stable mount for other components of the mechanism 1 while being sufficiently resilient to function as a spring. The housing 11 has a longitudinal axis, two transversely opposite longitudinally extending edges, and two longitudinal ends. A bent under rim 25 is formed along each longitudinal edge margin of the housing and together the two bent under rims 25 include six slots 27 (only three of which are visible) arranged in three transversely opposed pairs along the length of the housing 11 for receiving the rings 13 (see FIGS. 2A and 3A). At one housing end, two tabs 29 project upward for attaching an actuating lever 31 of the control structure. The opposite housing end does not have a lever, although it is understood that a mechanism with two levers or a mechanism with the lever attached between its ends does not depart from the scope of this invention. The raised plateau 23 of the housing has two openings 33, 35 for receiving and attaching mounting posts 37, 39 capable of securing the mechanism 1 to the notebook 5. Different shaped housings, including asymmetrical ones, and housings with different numbers of openings or slots do not depart from the scope of this invention.

The housing 11 loosely supports two hinge plates 19, 21 for pivoting motion to either close the rings 13 or open the rings 13. Each ring 13 includes two ring members 41 mounted on adjacent hinge plates 19, 21 and movable therewith between a closed position (see FIGS. 2A and 2B) and an open position (see FIGS. 3A and 3B). These ring members 41 are generally circular in cross section and are formed of suitable material such as steel. When they are in the closed position, each ring member 41 forms a substantially continuous, closed, "D"-shaped ring or loop for retaining loose-leaf pages and for allowing the pages to move along the rings 13 from one ring member 41 to the other. And when the ring members 41 are in the open position, each forms a discontinuous, open loop suitable for adding or removing pages. Although in the illustrated embodiment both ring members 41 can move, a mechanism having one movable ring member and one fixed does not depart from the scope of this invention. Additionally, a mechanism with more or less than three rings or with rings that form other shapes, such as a circular shape, when closed does not depart from the scope of this invention.

Figure 5:
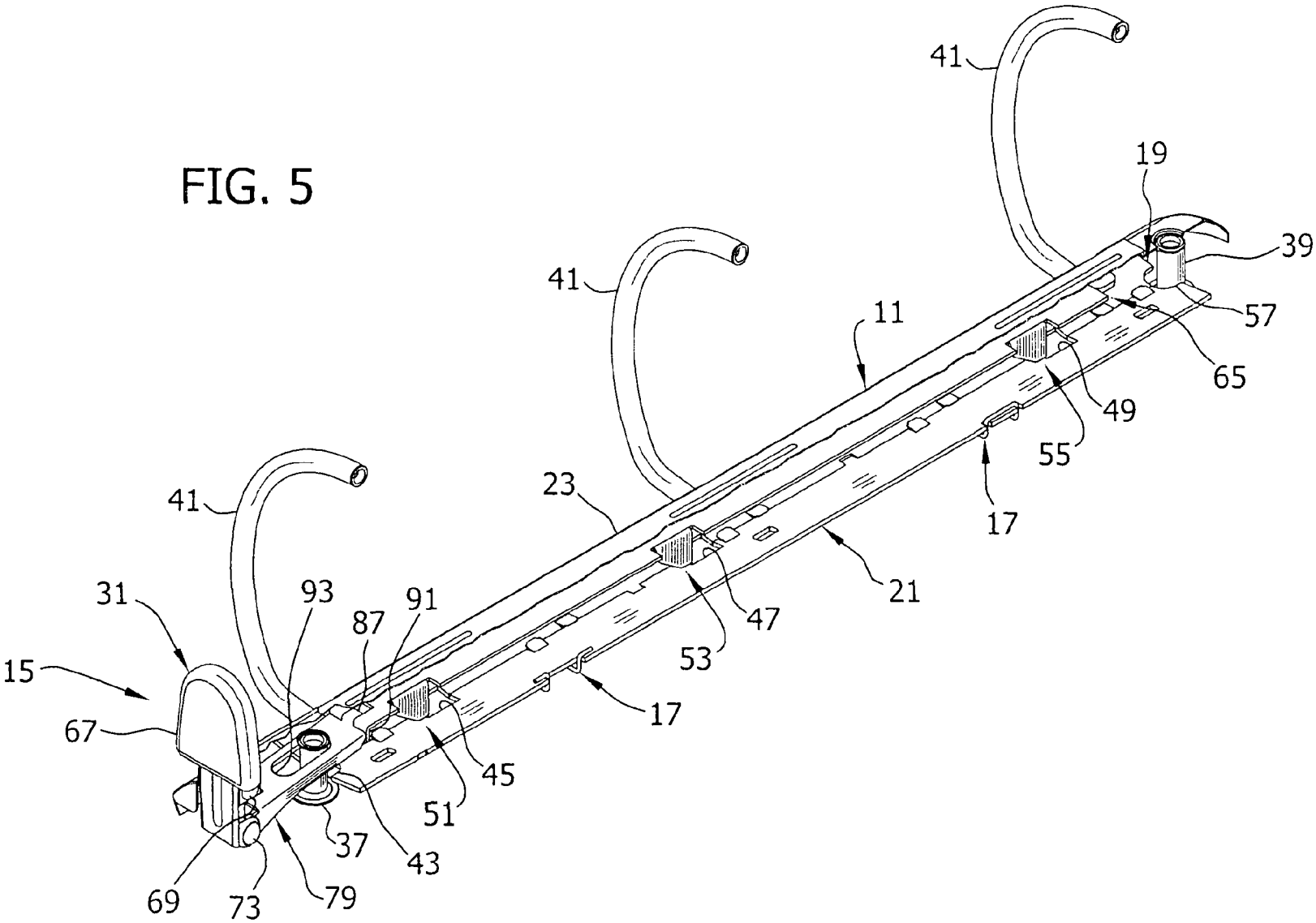
FIG. 5 is a perspective similar to FIG. 2A with a portion of a housing and ring members removed.

Referring now to FIGS. 4 and 5, the hinge plates 19, 21 are generally each a thin, elongate sheet having inner and outer longitudinal edge margins and two longitudinal ends. Each hinge plate 19, 21 includes five cutouts along its inner longitudinal edge margin so that when the hinge plates 19, 21 are interconnected, corresponding cutouts in each plate align to form five openings. A first opening 43, located near the housing end having the lever 31, receives a first of the mounting posts 37 through the hinge plates 19, 21. Second, third, and fourth openings 45, 47, 49 receive first, second, and third locking elements 51, 53, 55 respectively, as will be discussed hereinafter. A fifth opening 57, located near the housing end not having the lever 31, receives a second of the mounting posts 39 through the hinge plates 19, 21. Each hinge plate 19, 21 also includes two notches 59 and one cutout 61, both located along the plate's outer longitudinal edge margin. The notches 59 are arranged relatively side-by-side and define a tab 63 located toward one longitudinal end of each hinge plate 19, 21. The cutout 61 is located toward an opposite longitudinal end. The tab 63 and cutout 61 are positioned in reverse order on the two hinge plates 19, 21 so that when the plates 19, 21 interconnect one plate's tab 63 is across from a second plate's cutout 61. This facilitates attaching the wire form springs 17 to the underside of the interconnected hinge plates 19, 21, as will be described more fully hereinafter.

The interconnected hinge plates 19, 21 attach to one another in parallel arrangement along their adjoining inner longitudinal edge margins, forming a central hinge having a pivot axis. The housing 11 receives the interconnected plates 19, 21 such that each plates's outer longitudinal edge margin loosely fits in the housing's corresponding bent under rim 25 (see FIGS. 2B and 3B). Accordingly, the hinge plates 19, 21 are retained on the housing 11 but the edge margins are free to move within the rims 25, allowing the hinge plates 19, 21 to freely pivot about their pivot axis. The pivot axis moves up (i.e., toward the housing's raised plateau 23) when the plates 19, 21 pivot to open the ring members 41, and it moves down (i.e., away from the housing's raised plateau 23) when the plates 19, 21 pivot to close the ring members 41.

The control structure 15 of this embodiment generally includes the actuating lever 31, a travel bar 65, and the three locking elements 51, 53, 55. The actuating lever 31 is formed from a suitable rigid material or combination of materials, such as metal or plastic. It includes an enlarged head 67 to facilitate gripping and applying force to the lever 31. A first hinge pin 69 received through upper openings 71 in the lever and through the housing's tabs 29, mounts the lever 31 on the housing 11 for pivoting relative to the housing 11. A second hinge pin 73 is received through lower openings 75 in the lever 31 and through openings 77 in an intermediate connector 79, transforming the lever's pivoting motion into substantially linear travel bar motion. Although the travel bar's motion is not perfectly linear, it is still considered to be translational motion for purposes of the present invention.

The intermediate connector 79 is generally an elongate beam with a flat web and two side flanges. It includes a first end that is generally wider than a second end. More specifically, at the narrower second end the intermediate connector 79 includes a projecting tab 85 with an enlarged end 87 that is received in a slot 89 in a first end of the travel bar 65. This end of the travel bar is bent down to form a shoulder 91 against one side of which the intermediate connector 79 can bear to push the travel bar 65. The enlarged end 87 of the projecting tab 85 is engageable with the other side of the shoulder 91 to pull the travel bar 65 toward the lever 31. The slot 89 in which the tab 85 is received is elongate in the lengthwise direction of the travel bar 65. Thus, the intermediate connector 79 is able to freely pivot up and down with respect to the travel bar 65. As a result, the connector 79 transmits a linear movement to the travel bar 65 from the pivoting lever 31. Moreover, the travel bar 65 is allowed to move up and down without hindrance from the intermediate connector 79. The intermediate connector 79 also includes an elongate opening 93 for receiving the first mounting post 37 through the connector and allowing the connector to move relative to the mounting post 37.

Figure 6:
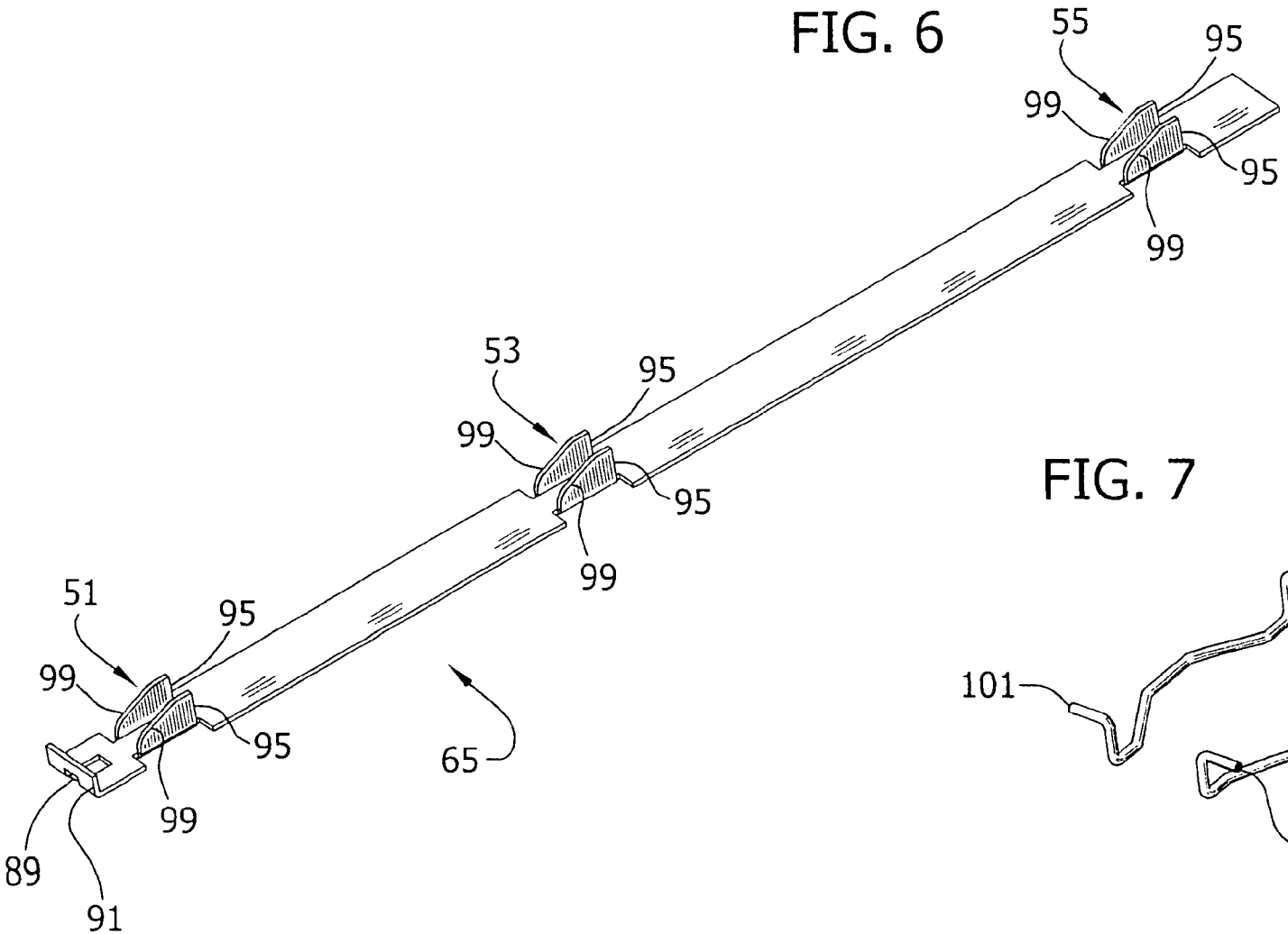
FIG. 6 is a bottom perspective of a travel bar of the first embodiment.

Now referring to FIGS. 4-6, the travel bar 65 receives the lever's pivoting motion and moves in translation generally lengthwise relative to both the housing 11 and the hinge plates 19, 21. The travel bar 65 is a relatively flat, elongate sheet made of metal or other sufficiently rigid material. It is disposed generally parallel to the longitudinal axis of the housing 11, under the housing's raised plateau 23 and above the hinge plates 19, 21. The travel bar 65 includes three integral locking elements 51, 53, 55 that move with the travel bar 65 in translation and, depending on the travel bar's position, can either (1) pivot the hinge plates 19, 21 for closing the ring members 41 and then block the hinge plates' pivoting motion for locking the ring members 41 closed or (2) allow the wire form springs 17 to pivot the hinge plates 19, 21 for opening the ring members 41 (i.e., the locking elements 51, 53, 55 can register with openings 45, 47, 49 in the hinge plates 19, 21, thereby allowing the wire form springs 17 to freely act against the hinge plates 19, 21 and pivot them, as will be discussed hereinafter).

As particularly shown in FIG. 6, in this embodiment the locking elements 51, 53, 55 each comprise two spaced apart flanges 95 formed as one piece with the travel bar 65 and folded downward 90° from a longitudinal edge margin of the bar. Accordingly, there are three flanges 95 on each side of the travel bar 65, and each flange's planar surface is substantially parallel to that of every other flange 95 and to a longitudinal axis of the travel bar 65. A lower edge portion of each flange is angled, forming a cam surface 99 for engaging the hinge plates 19, 21 and for causing them to pivot to close the ring members 41. The angle is such that once the ring members 41 close, the locking elements 51, 53, 55 slide into position for locking the ring members 41 together. In addition, the locking elements 51, 53, 55 are spaced along the length of the travel bar 65 to correspond with the second, third, and fourth openings 45, 47, 49 in the hinge plates 19, 21 when the ring members 41 are open. It will be understood that locking elements may be formed as a single piece with a travel bar, or as more than two pieces, and that control structures using more or fewer than three locking elements, or differently shaped locking elements do not depart from the scope of this invention.

Figure 7:
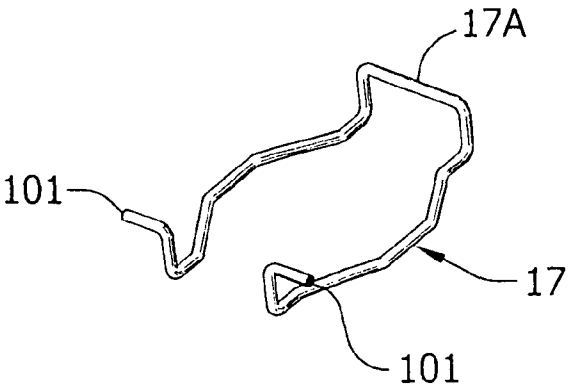
FIG. 7 is a perspective of a wire form spring of the first embodiment.
Figure 8:
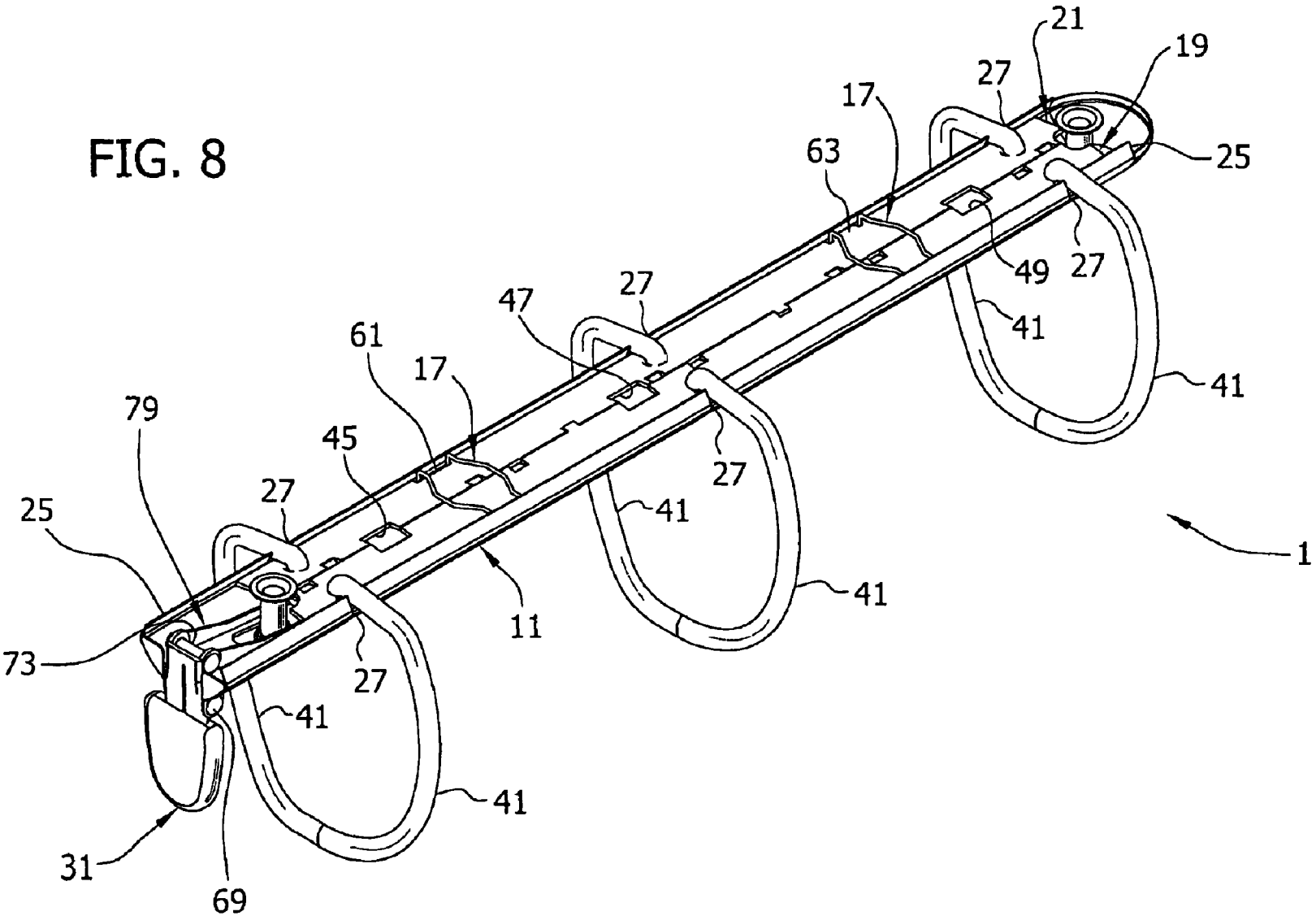
FIG. 8 is a bottom perspective of the ring binder mechanism at the closed and locked position.
Figure 9:
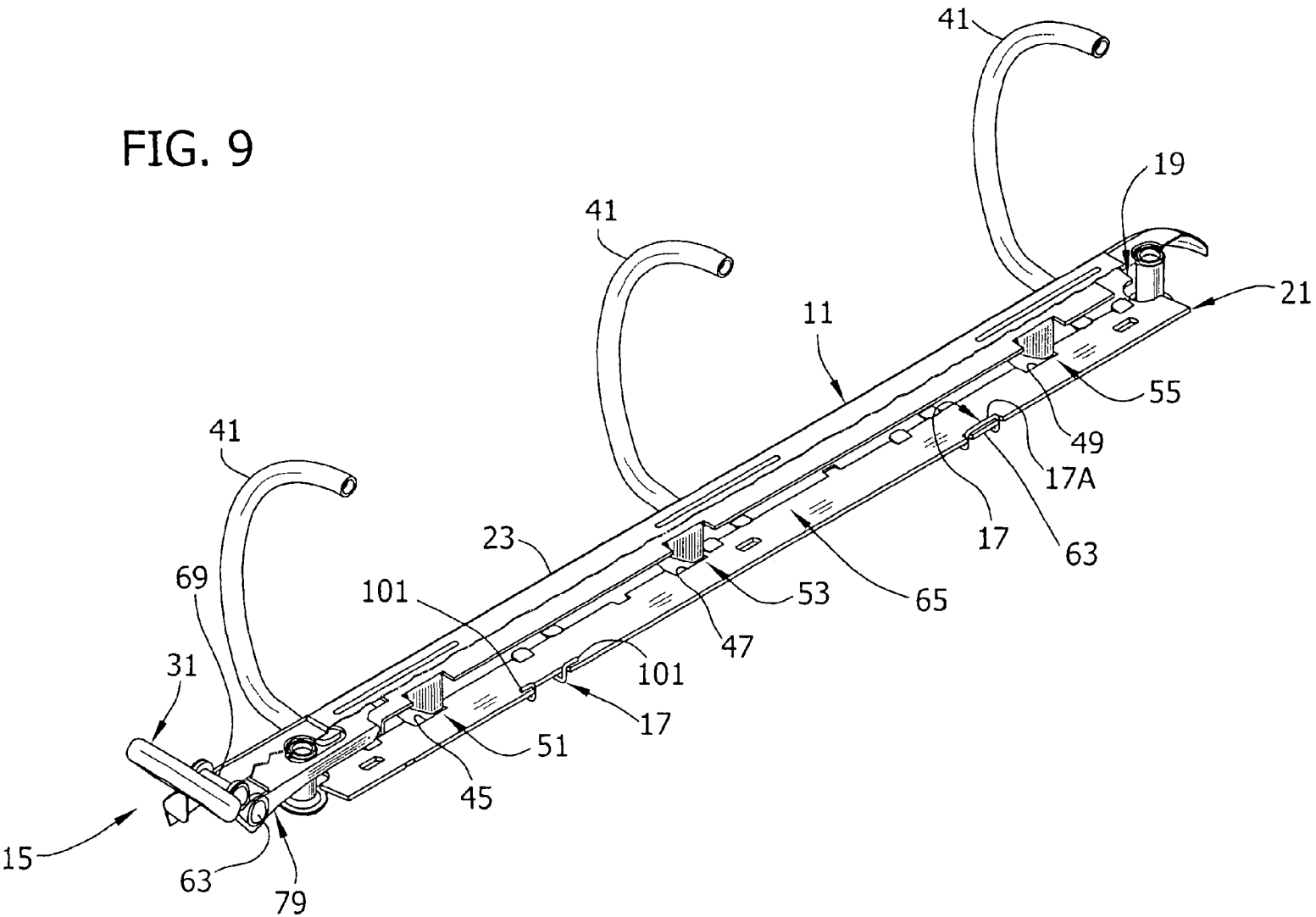
FIG. 9 is a perspective similar to FIG. 5 with the mechanism at an intermediate, transitional position between the open position and the closed and locked position.
Figure 10:
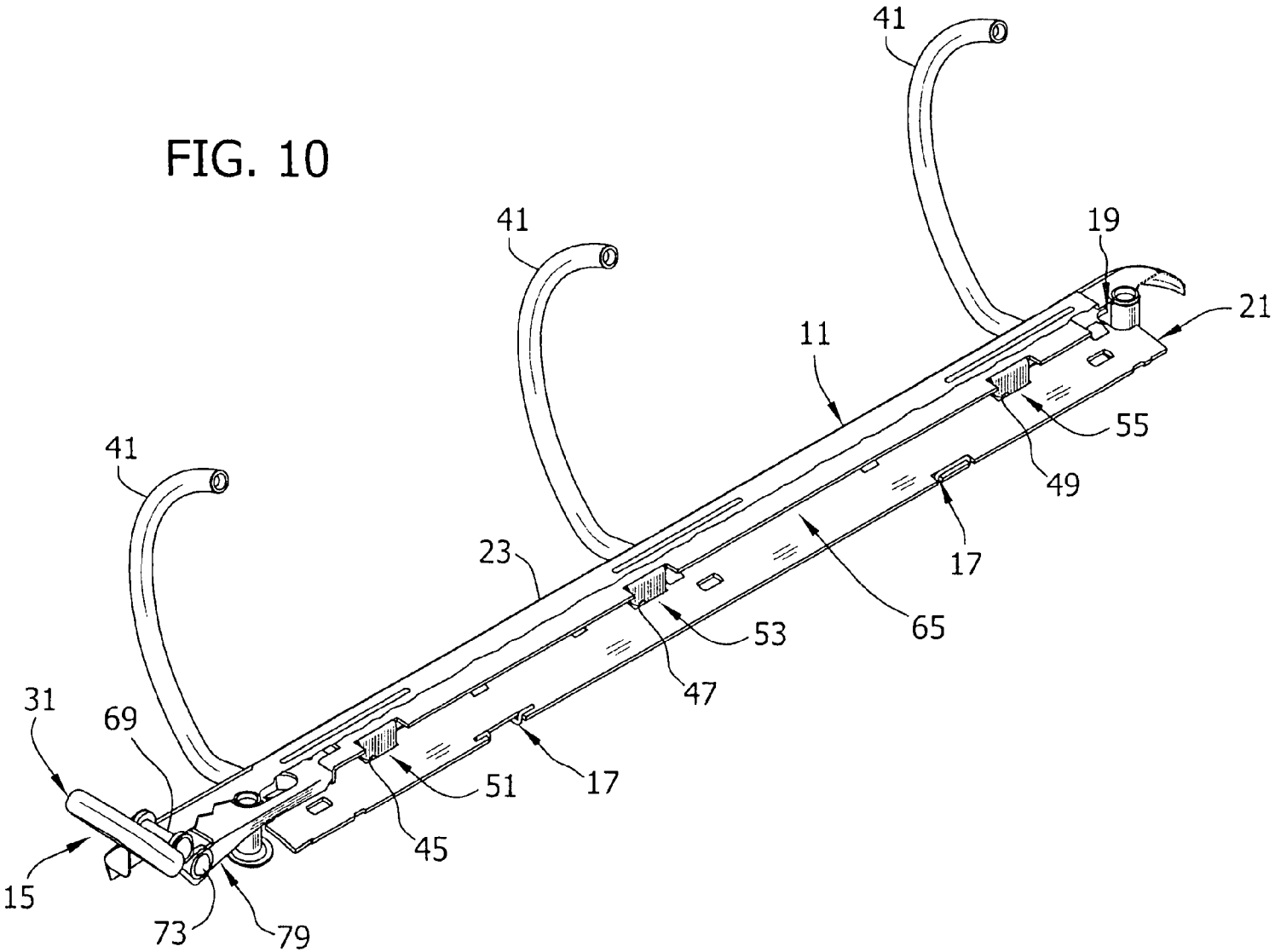
FIG. 10 is a perspective similar to FIG. 5 with the mechanism at the open position.
Figure 11:
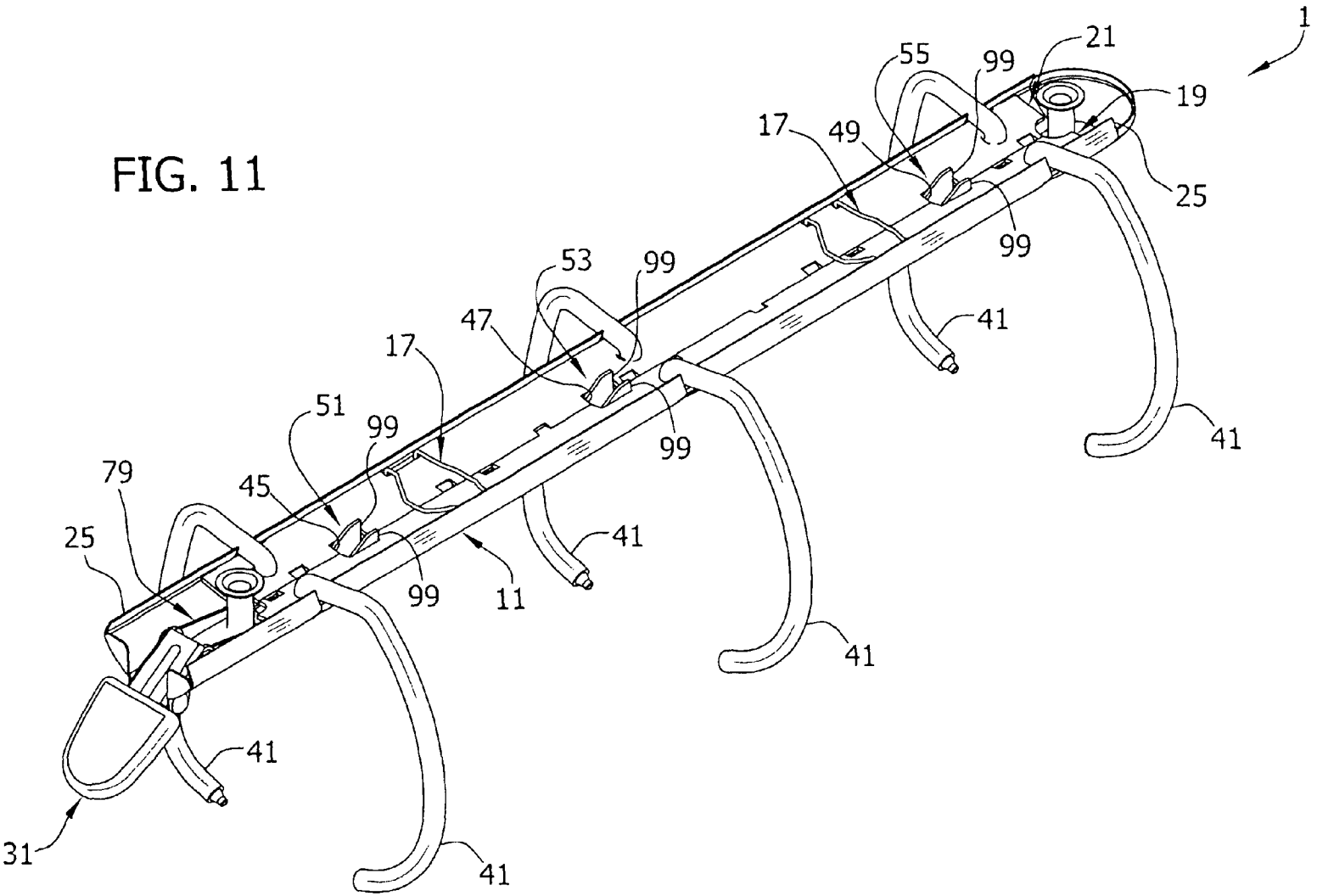
FIG. 11 is a perspective similar to FIG. 8 with the mechanism at the open position.

As shown in FIGS. 7-9, a wire form spring 17 of this embodiment is a generally round wire formed roughly into an elongate octagon with an open end and a closed end 17A (the open end forming one of the sides of the octagon). The closed end 17A is bent upward 90° so that it fits into the notches 59 and over the tab 63 of one of the interconnected hinge plates 19, 21. The free end of the tab 63 is received behind the rim 25 of the housing so that the closed end 17A of the spring is held on the tab 63. The open end of each spring has two wire tips 101 that are each bent twice into a generally hook shape. A first bend is 90° upward and a second bend is 90° outward. These tips 101 releasably fit into the cutout 61 of the second interconnected hinge plate 19, 21 so that a body of the wire form spring 17 is positioned substantially beneath the interconnected plates 19, 21. As attached, the wire form springs 17 are relaxed when the hinge plates 19, 21 are oriented so that the ring members 41 are open. The body of the wire form spring 17 is bowed slightly upward (i.e., toward the interconnected plates 19, 21 (see FIG. 3B)) so that exterior surfaces of the interconnected hinge plates 19, 21 form an angle A that is less than 180° (i.e., the hinge plates' pivot axis is above a coplanar position of the hinge plates 19, 21). When the locking elements 51, 53, 55 move the hinge plates 19, 21 down and through the coplanar position for closing the ring members 41 (see FIG. 2B), each bowed wire form spring 17 flattens and becomes stressed. Conversely, when the locking elements 51, 53, 55 move into registration with respective openings 45, 47, 49 in the hinge plates 19, 21, the stressed wire form springs 17 automatically act on the hinge plates 19, 21 and pivot them up and through the coplanar position, opening the ring members 41. It is understood that while the illustrated mechanism 1 includes two wire form springs 17, mechanisms having fewer than two or more than two wire form springs do not depart from the scope of this invention.

Now referring to FIGS. 2A-3B, 5, and 8-11, the control structure 15 is capable of selectively controlling the mechanism's movement between a closed and locked position and an open position. At the closed and locked position (FIGS. 2A, 2B, 5 and 8), the ring members 41 are together and cannot be pulled apart. In this position the hinge plates 19, 21 are oriented so that their pivot axis is slightly below the coplanar position and the angle A between their exterior surfaces 103 is at its greatest. Additionally, the actuating lever 31 is relatively vertical and the travel bar 65 is positioned closer to the housing end having the lever 31. As such, the first, second, and third locking elements 51, 53, 55 are positioned between the hinge plates 19, 21 and the housing 11, substantially out of registration with the respective openings 45, 47, 49 in the hinge plates 19, 21. In this travel bar locking position, the locking elements 51, 53, 55 firmly oppose any force tending to open the ring members 41 because they are generally sized, along with the travel bar 65, to fully occupy the area between the hinge plates 19, 21 and the housing's raised plateau 23. So as the hinge plates 19, 21 push up on the locking elements 51, 53, 55 (i.e., such as when the hinge plates 19, 21 pivot to open the ring members 41) the hinge plates immediately engage the locking elements 51, 53, 55, tending to force both the locking elements 51, 53, 55 and the travel bar 65 up. The housing's raised plateau 23 resists this movement, however, blocking the hinge plates' pivoting motion and preventing the ring members 41 from opening.

In order to open the mechanism 1, an operator pivots the lever 31 outward and downward (FIG. 9). This pushes the intermediate connector 79 and travel bar 65 away from the housing end having the lever 31, and translates the travel bar 65 out of its locking position. The travel bar 65 moves until the locking elements 51, 53, 55 each substantially register with the respective second, third, and fourth openings 45, 47, 49 in the hinge plates 19, 21. At this intermediate, transitional position, the locking elements 51, 53, 55 no longer block the hinge plates' pivoting motion. This allows the wire form springs 17 to automatically act on the hinge plates 19, 21, pivoting the hinge plates 19, 21 up and through the coplanar position (and thereby overcoming any spring force of the housing 11 that resists hinge plate movement through the coplanar position) so that their openings 45, 47, 49 pass over the locking elements 51, 53, 55 and the ring members 41 open. At this open position (FIGS. 3A, 3B, 10 and 11), the cam surfaces 99 of each locking element 51, 53, 55 fully project through the hinge plates' respective openings 45, 47, 49 and the angle A between the hinge plates' exterior surfaces 103 is at its smallest. The wire form springs 17 and the housing's spring force keep the ring members 41 open, and the operator may let go of the lever 31 to load or remove paper from the mechanism 1.

Figure 2A:
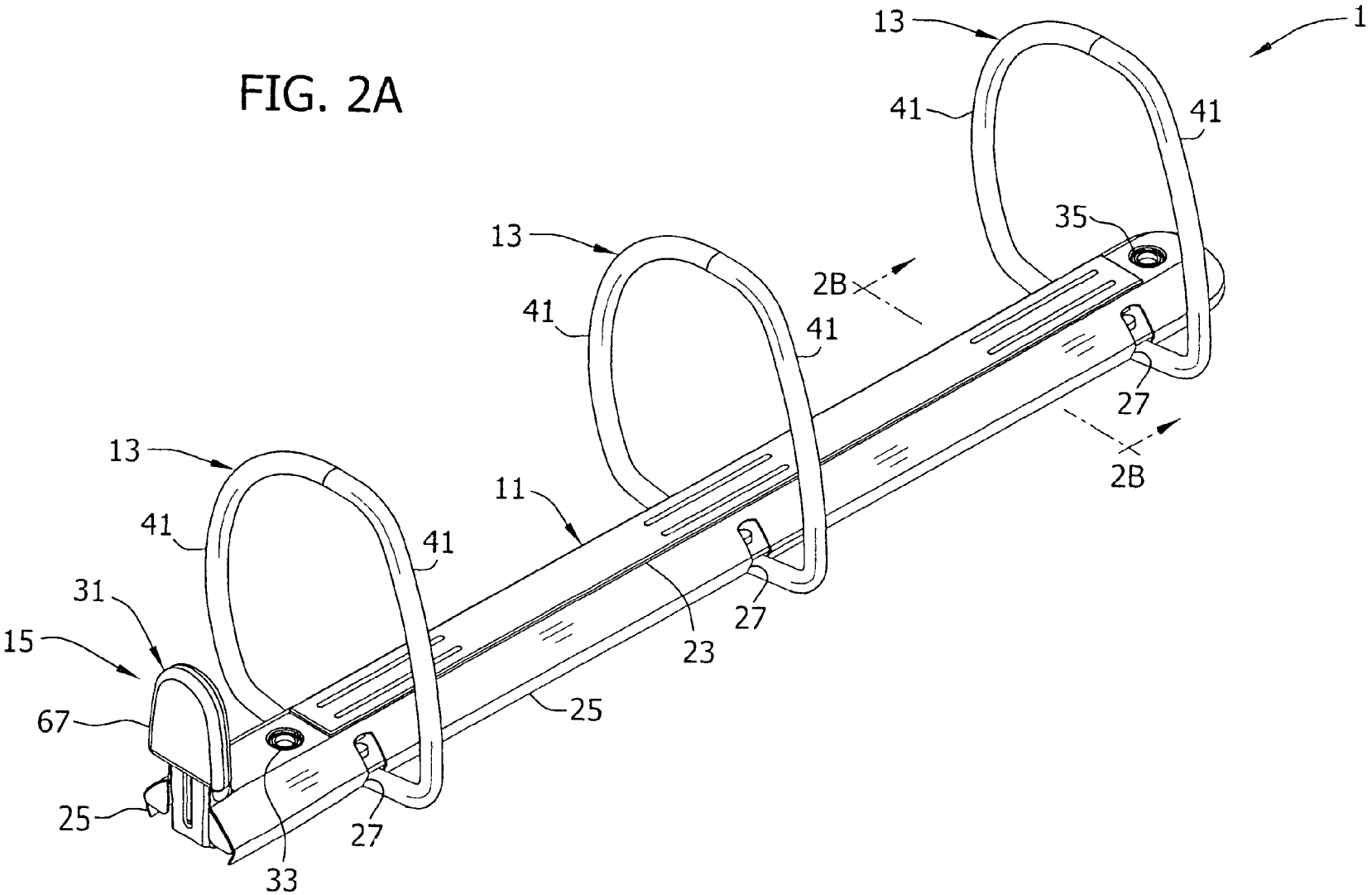
FIG. 2A is a perspective of the mechanism at a closed and locked position.
Figure 2B:
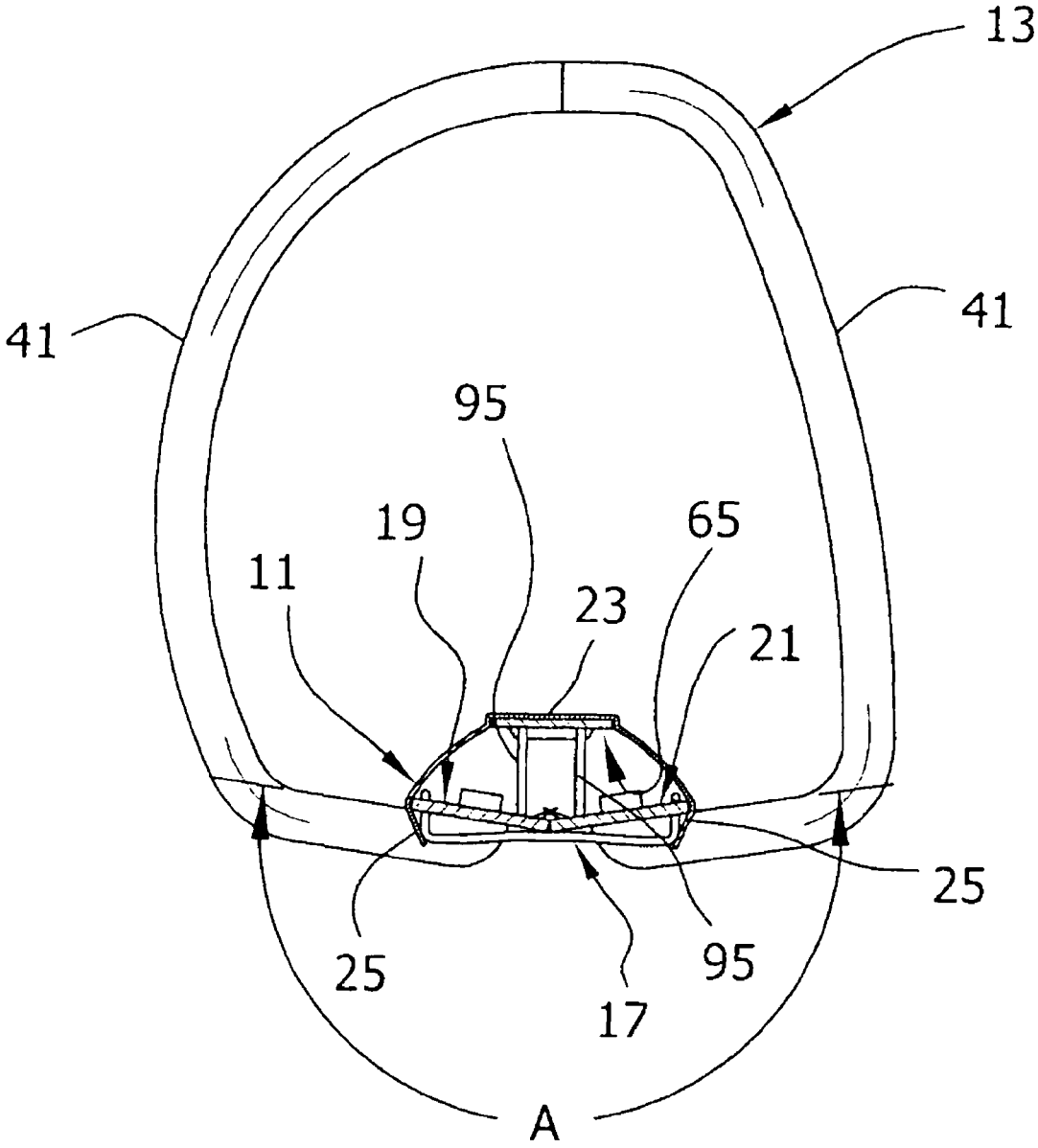
FIG. 2B is a section taken on line 2B-2B of FIG. 2A.
Figure 3A:
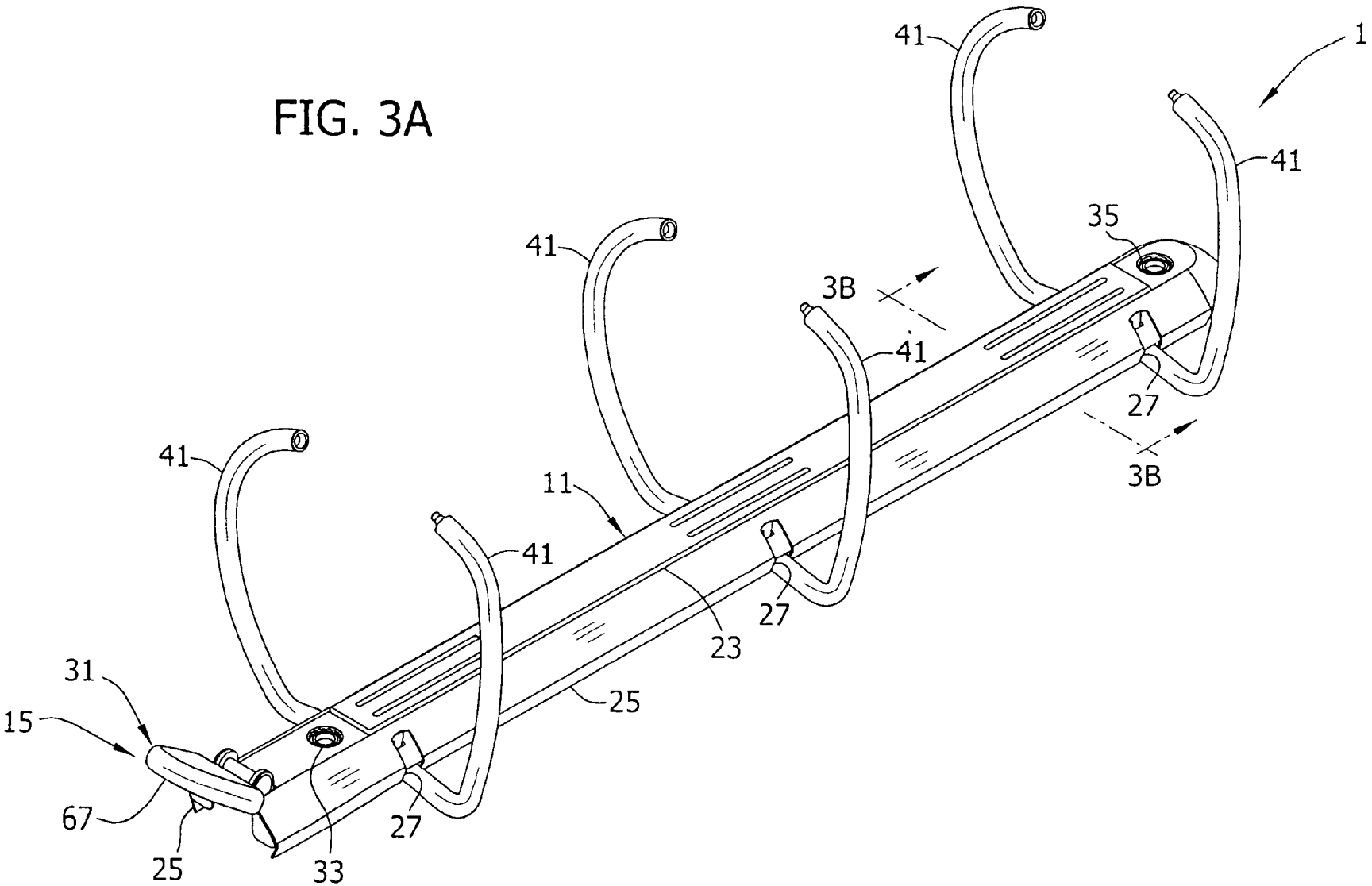
FIG. 3A is a perspective similar to FIG. 2A with the mechanism at an open position.
Figure 3B:
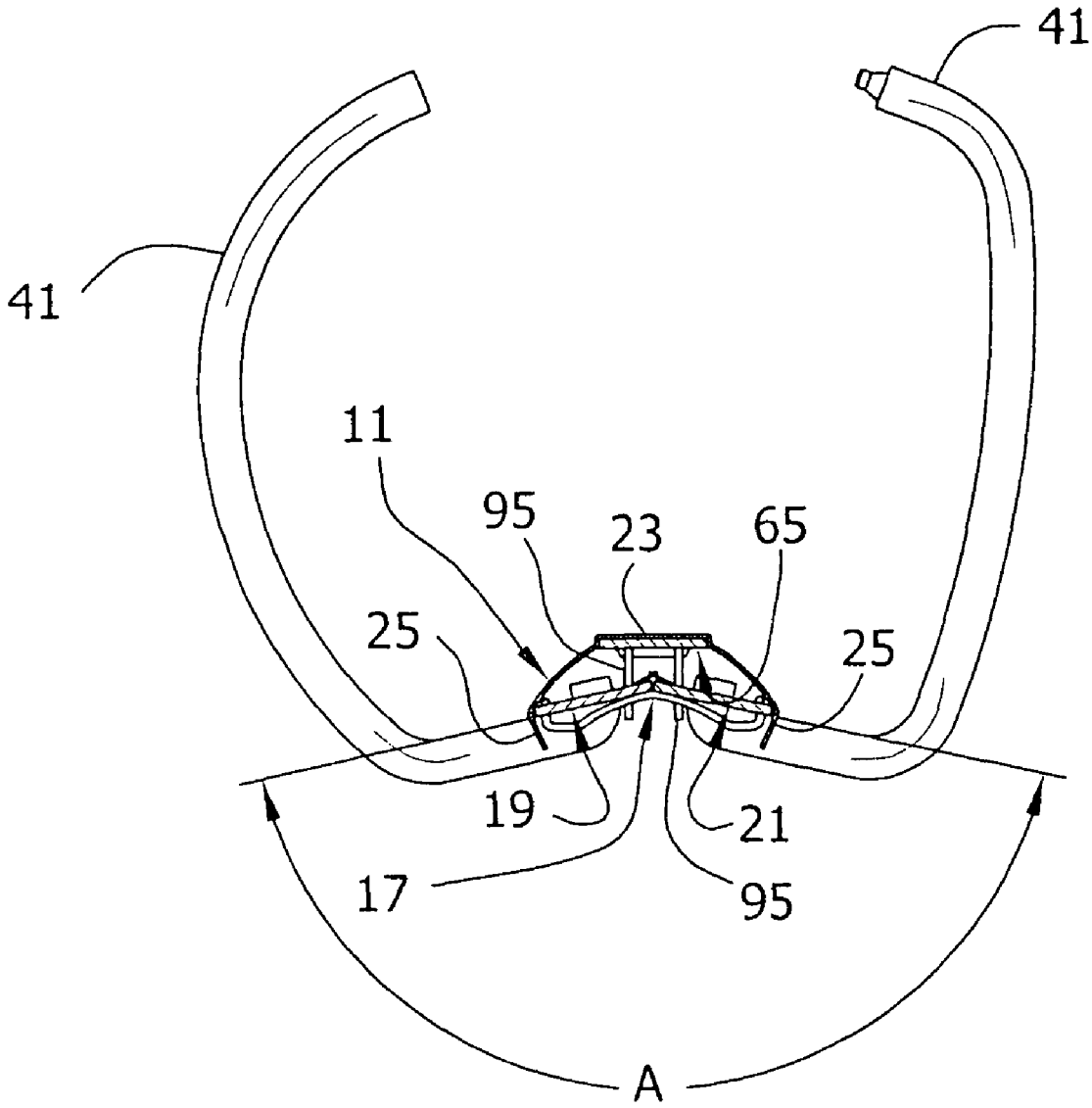
FIG. 3B is a section taken on line 3B-3B of FIG. 3A.

To return the mechanism 1 back to the closed and locked position, the operator pivots the lever 31 inward and upward (FIGS. 2A, 5, and 8). This pulls the intermediate connector 79 and travel bar 65 back toward the housing end mounting the lever 31, causing the cam surfaces 99 of the locking elements to engage the hinge plates 19, 21 at edges of the respective openings 45, 47, 49. As the operator continues pivoting the lever 31 and moving the travel bar 65, the locking elements 51, 53, 55 begin to pivot the hinge plates 19, 21, thereby overcoming forces opposing such hinge plate 19, 21 motion (i.e., a sliding friction force between the locking elements' cam surfaces 99 and the hinge plates 19, 21, the wire form spring's force resisting flattening, and the housing's spring force resisting hinge plate movement through the coplanar position). Thus, the hinge plates 19, 21 slowly slide down each cam surface 99 and softly move the ring members 41 together. Once the ring members 41 fully close, the travel bar 65 returns to its locking position and the locking elements 51, 53, 55 fully return to their position blocking the hinge plates' pivoting motion. As above described, in this mechanism 1 the locking elements 51, 53, 55 bias the hinge plates 19, 21 to pivot only for closing and locking the ring members 41. The locking elements 51, 53, 55 are incapable of moving the hinge plates 19, 21 for opening the ring members 41. This is accomplished by the wire form springs 17.

The ring binder mechanism of the present invention securely retains loose-leaf pages when the ring members 41 are closed. In this position, the locking elements 51, 53, 55 and travel bar 65 generally completely occupy the area between the hinge plates 19, 21 and the housing's raised plateau 23, and the locking elements 51, 53, 55 are positioned substantially out of registration with the respective openings 45, 47, 49 in the hinge plates 19, 21. Additionally, the housing 11 encases the locking elements 51, 53, 55, providing a barrier to outside forces from unintentionally moving the locking elements 51, 53, 55 into registration with the openings 45, 47, 49. As a result, the travel bar 65 and the locking elements 51, 53, 55 fully resist any hinge plate movement tending to open the ring members 41 and positively lock the ring members 41 together, reducing the mechanism's chance of accidentally opening. Furthermore, this mechanism is easier to manipulate when the ring members 41 are full of pages. The lever 31 can move the locking elements 51, 53, 55 for unlocking the ring members 41, as opposed to prior art mechanisms where the ring members themselves directly lock together. Moreover, the locking elements 51, 53, 55 of this mechanism distribute a locking force generally uniformly to the ring members 41 and minimize gaps between the closed members 41 because the locking elements 51, 53, 55 are uniformly spaced along the length of the hinge plates 19, 21.

This mechanism 1 also reduces the undesirable snapping motion of ring members 41 as they close because the locking elements' cam surfaces 99 control the pivoting motion of the hinge plates 19, 21. As the operator pivots the lever 31 for closing the ring members 41, the locking elements 51, 53, 55 slowly move the hinge plates 19, 21 and gently bring the ring members 41 together. The wire form springs 17 cause the hinge plates 19, 21 to pivot up and through the coplanar position for opening the ring members 41. As such, the wire form springs 17 effectively perform the same functions as the housing's spring force. Consequently, the housing's spring force may be reduced, or possibly eliminated, so that only the wire form springs 17 act on the hinge plates 19, 21. This makes it easier to move the hinge plates 19, 21 down and through the coplanar position when closing the ring members 41.

Furthermore, this mechanism 1 opens more easily than prior art mechanisms. The operator need only move the travel bar 65 a short distance before its locking elements 51, 53, 55 align with corresponding openings 45, 47, 49 in the hinge plates 19, 21 and the wire form springs 17 automatically act on the hinge plates 19, 21, pivoting them to open the ring members 41. Similarly, the lever's pivoting movement reduces the magnitude of force necessary to cause this travel bar movement because of the mechanical advantage given by the lever 31.

Figure 12:
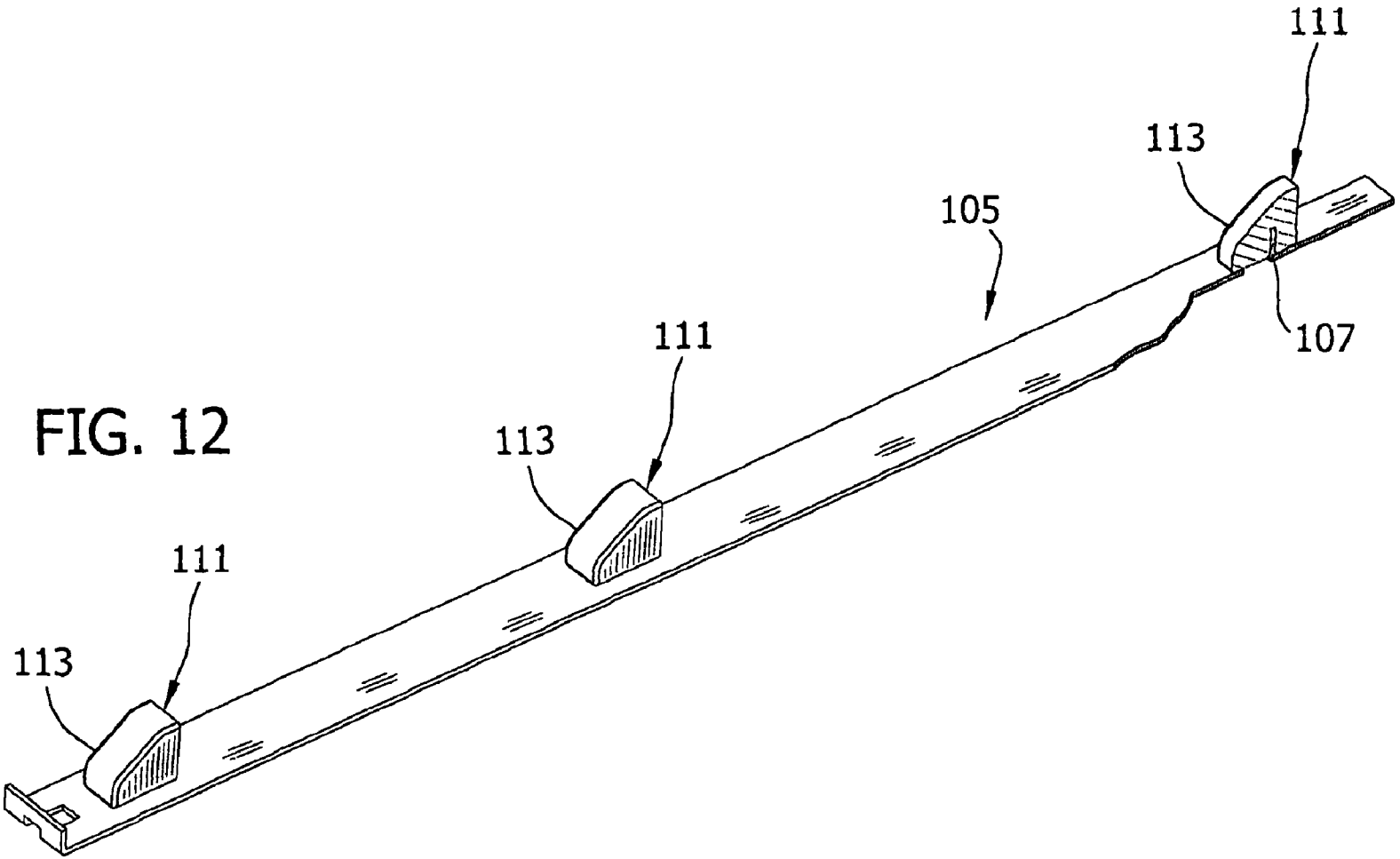
FIG. 12 is a bottom perspective of an alternative version of the travel bar with a portion of the travel bar and a portion of a locking element broken away.
Figure 13A:
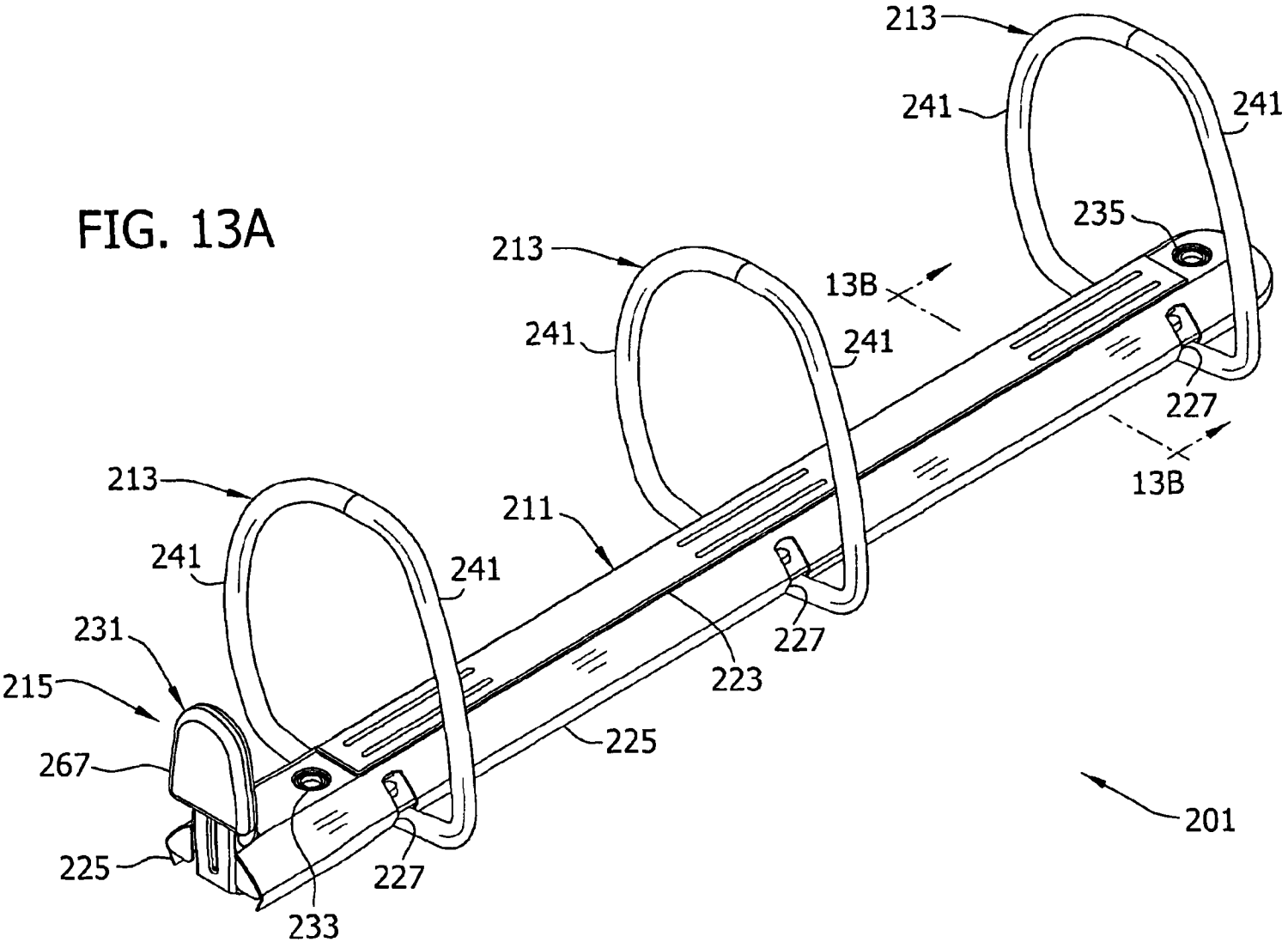
FIG. 13A is a perspective of a second embodiment of a ring binder mechanism of the present invention at a closed and locked position.
Figure 13B:
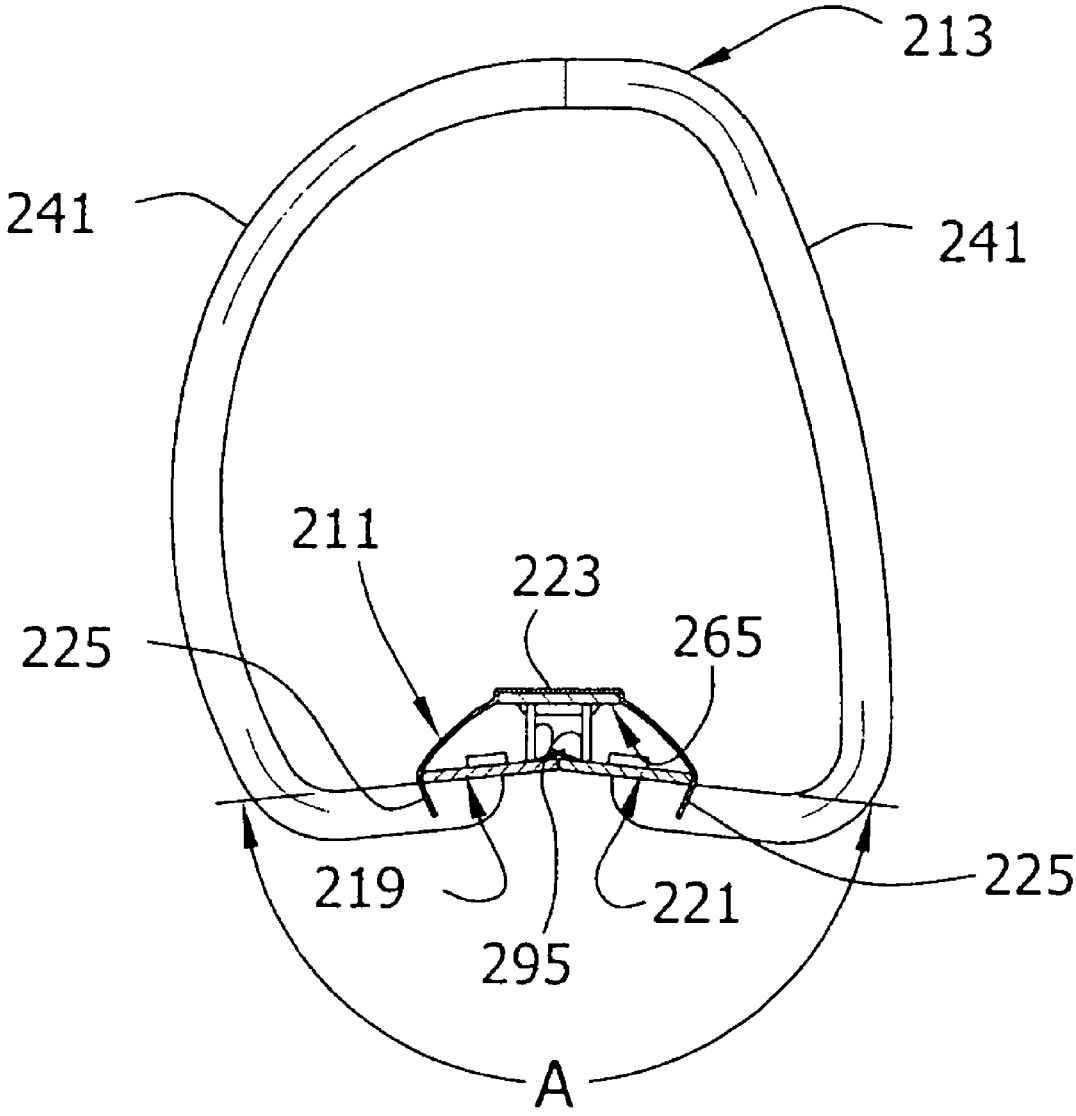
FIG. 13B is a section taken on line 13B-13B of FIG. 13A.
Figure 14A:
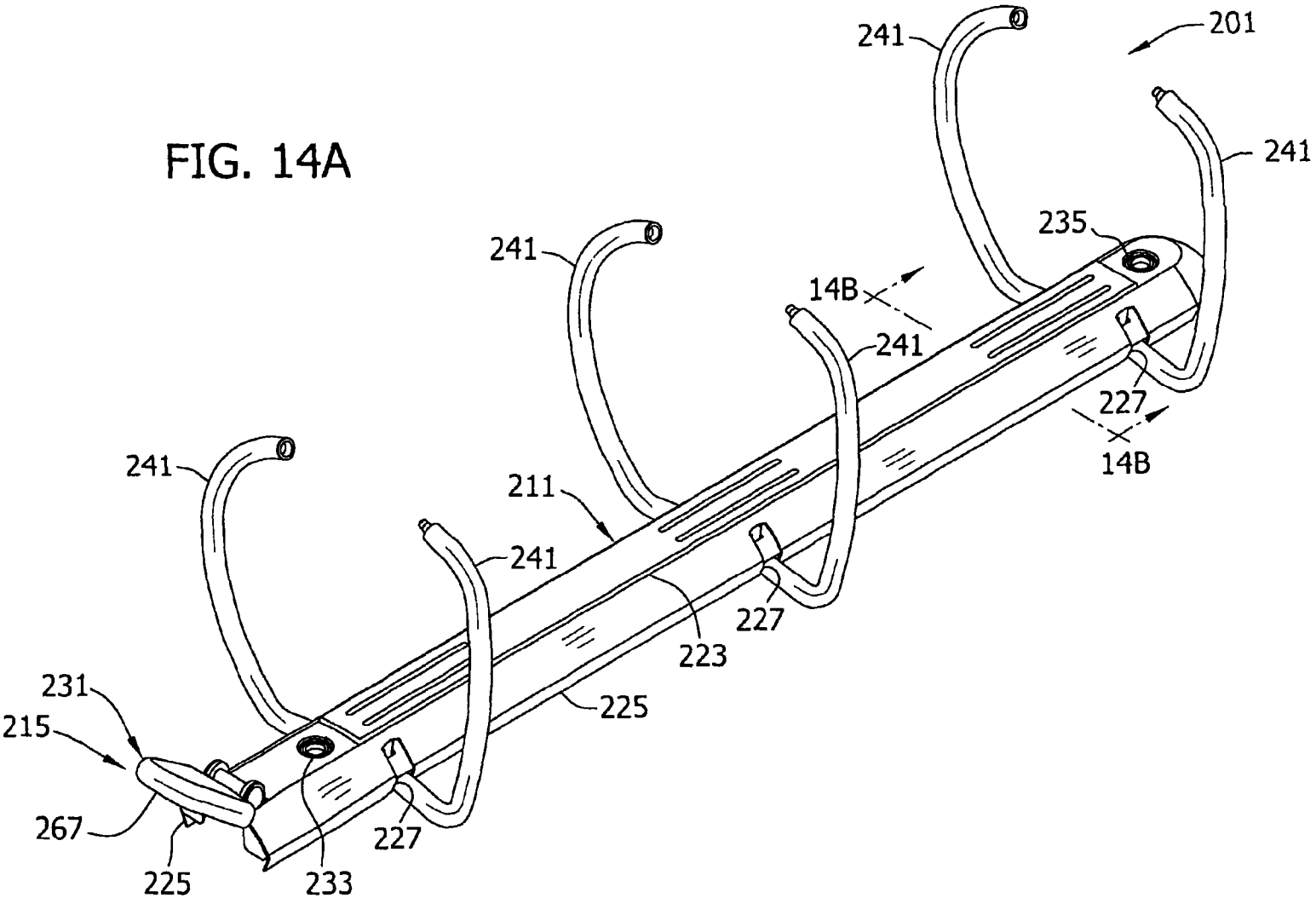
FIG. 14A is a perspective similar to FIG. 13A with the mechanism at an open position.
Figure 14B:
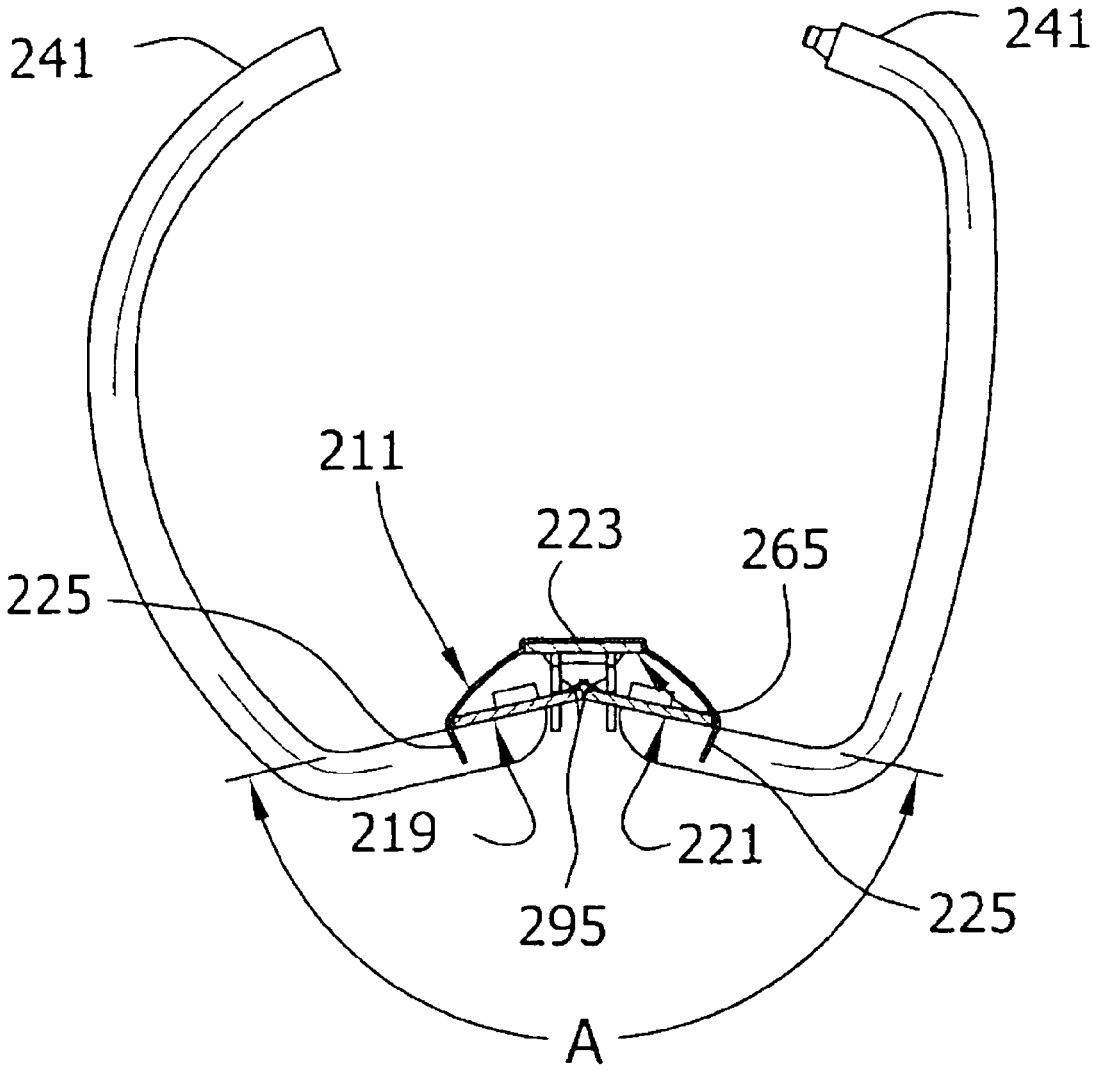
FIG. 14B is a section taken on line 14B-14B of FIG. 14A.

Now referring to FIG. 12, an alternative version of the travel bar is generally designated by reference numeral 105. This travel bar 105 includes three tabs 107 (only one of which is shown) formed as one piece with the travel bar 105. Each tab 107 is struck downward 90° from the bar's surface and is capable of receiving a locking element 111, which in this embodiment is formed separately from the travel bar 105 and secured to the tab 107. The locking element 111 is generally block-shaped and may be made of plastic or other suitable material capable of resisting the hinge plates' pivoting motion and of wedging the hinge plates 19, 21 to move the ring members 41 together. The locking element 111 also includes an angled cam surface 113 substantially similar to the cam surfaces 99 of the travel bar described for the mechanism 1 of the first embodiment. Accordingly, each embodiment described herein may include this alternative version travel bar 105.

FIGS. 13A-14B illustrate a second embodiment of the ring binder mechanism of the present invention. The mechanism of this embodiment is generally designated by reference numeral 201. Parts of the mechanism of this second embodiment corresponding to parts of the mechanism of the first embodiment are indicated by the same reference numerals, plus "200". This embodiment is substantially similar to the first embodiment, but does not include wire form springs under hinge plates. In this embodiment a spring force of a housing 211 causes the hinge plates 219, 221 to pivot for opening ring members 241. The hinge plates 219, 221 pivot in the housing 211 so that a pivot axis never moves below a coplanar position when the ring members 241 move between a closed and an open position (i.e., an angle A (FIGS. 13B and 14B) between exterior surfaces of the hinge plates is always less than 180°). Thus, the spring force of the housing 211 only acts to open the ring members 241 and never to close the ring members. Also in this embodiment, the hinge plates 219, 221 do not include notches or a cutout along their outer longitudinal edge margins because there are no wire form springs. But in all other aspects, the hinge plates 219, 221 of this embodiment are identical to the hinge plates 19, 21 of the first embodiment.

Figure 15:
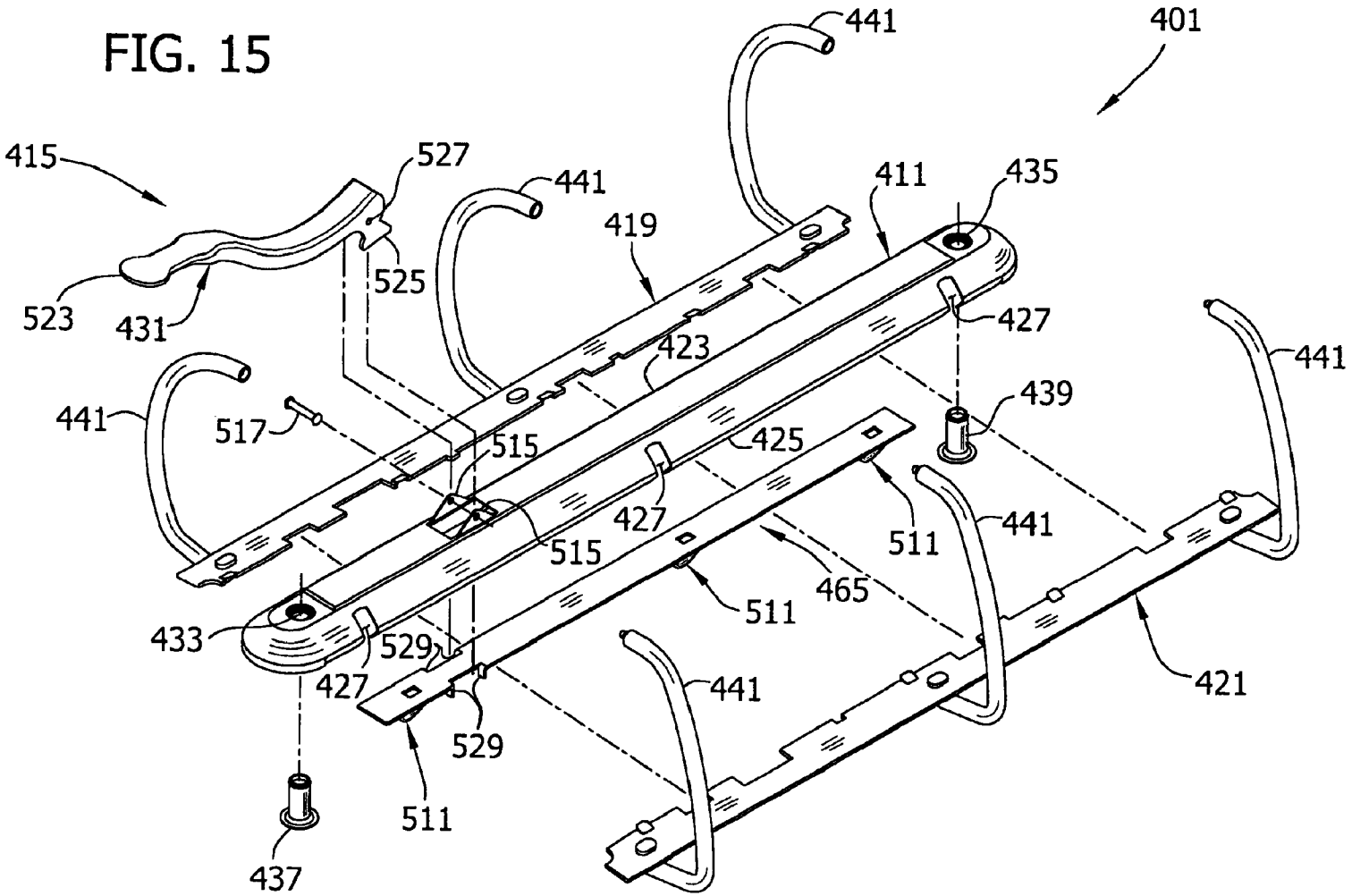
FIG. 15 is an exploded perspective of a ring binder mechanism of the present invention according to a third embodiment.
Figure 16A:
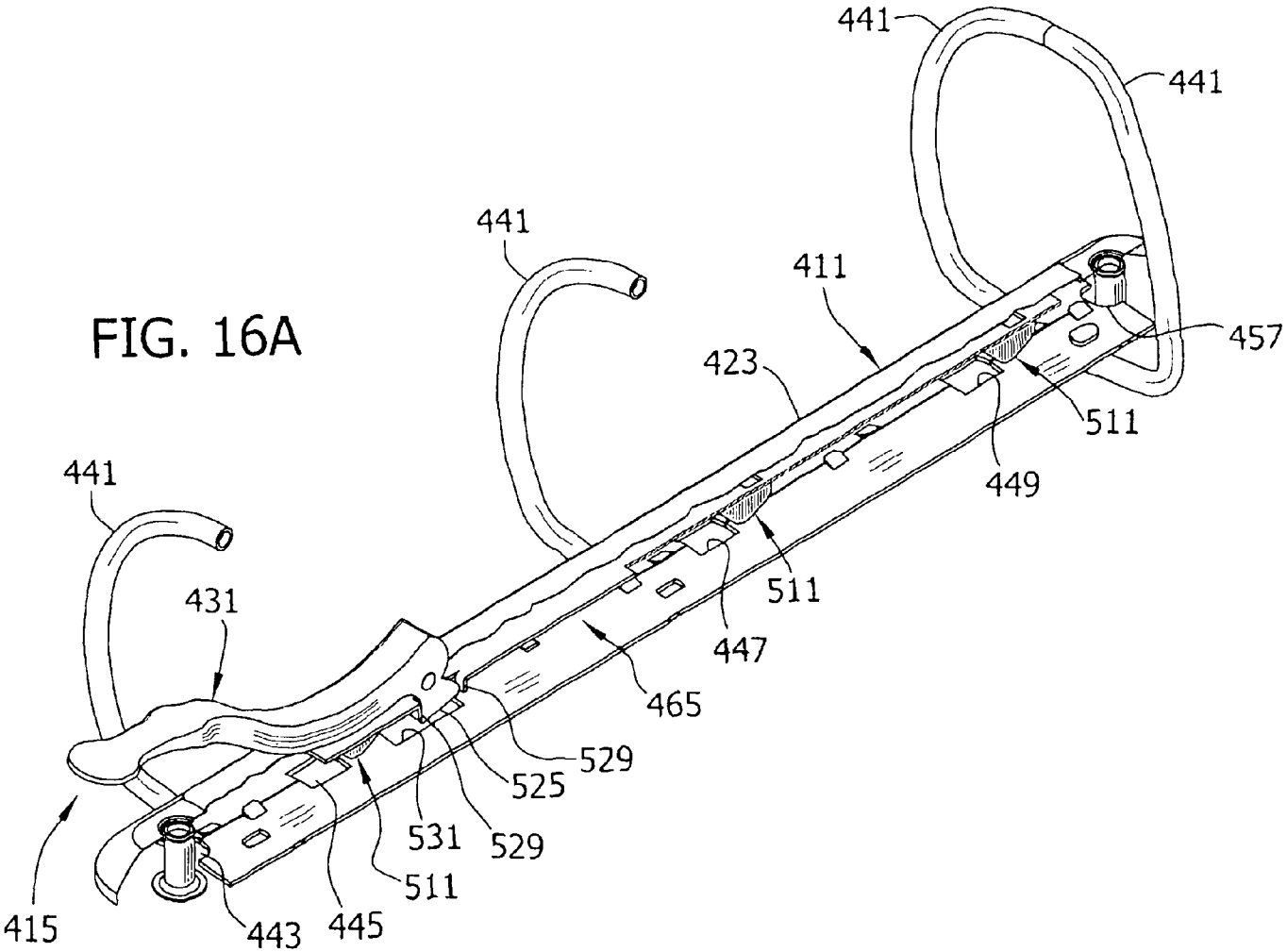
FIG. 16A is a perspective of the mechanism of FIG. 15 at a closed and locked position with a portion of a housing, a travel bar, locking elements, and two ring members removed.
Figure 16B:
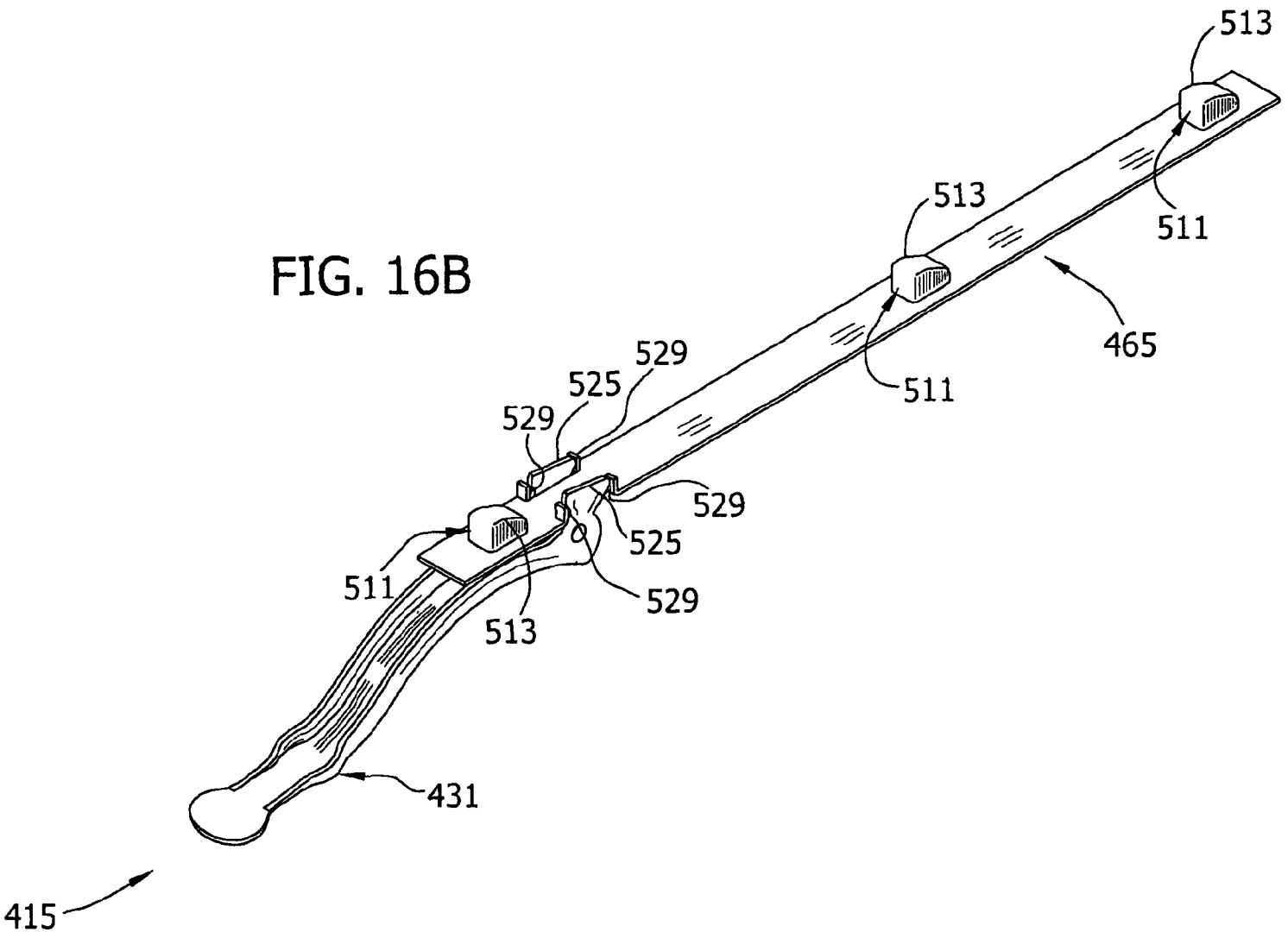
FIG. 16B is a bottom perspective of a control structure of the mechanism.
Figure 17:
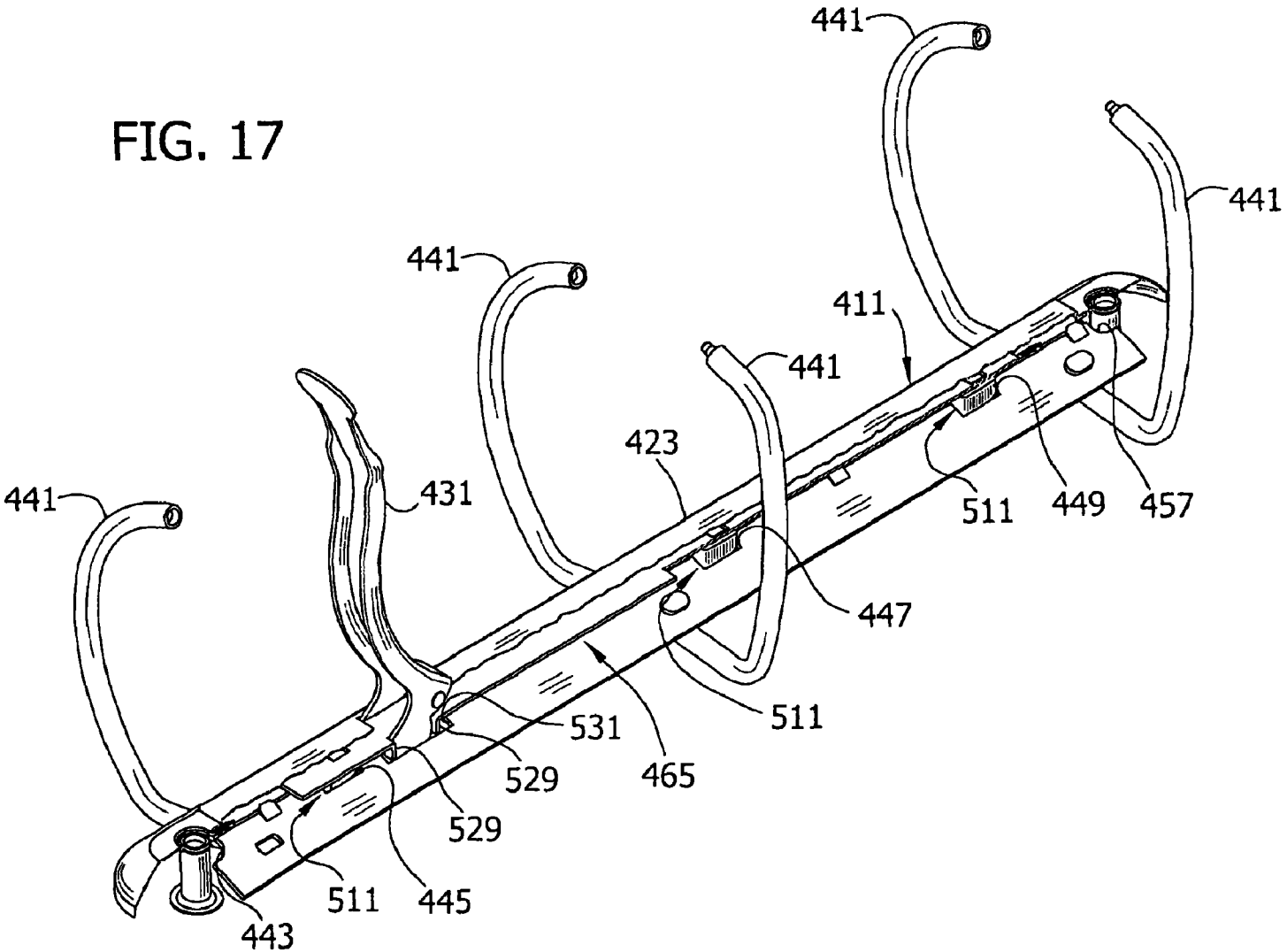
FIG. 17 is a perspective similar to FIG. 16A with the mechanism at an open position.

FIGS. 15-17 illustrate a third embodiment of the present invention. The mechanism of this invention is generally designated by reference numeral 401. Parts of this embodiment which correspond to parts of the first embodiment are indicated by the same reference numerals, plus "400". This embodiment is similar to the second embodiment in that a housing 411 supports hinge plates 419, 421 for pivoting motion such that a pivot axis of the hinge plates 419, 421 never moves to or below a coplanar position when ring members 441 move between a closed and locked position and an open position. In this embodiment, however, a lever 431 of a control structure 415 is located between two symmetrical ends of the housing 411. To accommodate this, the housing 411 includes two tabs 515, extending upward from a raised plateau 423 of the housing. The tabs 515 are capable of receiving a hinge pin 517 for pivotally mounting the lever 431 on the housing 411. In this embodiment, the lever 431 is generally an elongate, bowed beam that includes a web and two downward turned side flanges. At one end, the side flanges taper into the web, forming a flat surface 523 to grasp and pivot the lever 431. At the other end, cam surfaces 525 project downward from the side flanges. Also at this end, a hole 527 passes through both side flanges for receiving the hinge pin 517 that mounts the lever 431 on the housing 411.

The mechanism 401 of this embodiment uses no intermediate connector to transfer the lever's pivoting movement into linear movement of a travel bar. Instead, the lever's cam surfaces 525 loosely fit between opposing shoulders 529 formed in the travel bar 465 so that the lever's pivoting movement directly translates the travel bar 465 relative to the housing 411. The loose reception of each cam surface 525 between a respective pair of shoulders 529 allows the cam surfaces 525 to pivot and yet bear against one or the other of the shoulders 529 for linearly moving the travel bar 465. The shoulders 529 are located toward one end of the travel bar 465, along longitudinal edge margins of the travel bar, and are positioned so that one shoulder 529 is directly opposite the other. Each shoulder 529 is formed by bending two opposing pieces downward 90° so that a plane of each piece is perpendicular to the travel bar 465. In this embodiment the travel bar 465 does not include an end flange or a slot because there is no intermediate connector for it to receive.

Referring particularly to FIGS. 16A-17, operation of this embodiment is substantially similar to the operation of the second embodiment. In this embodiment, however, at a closed and locked position of FIG. 16A, the lever 431 is relatively horizontal and generally parallel to the housing's raised plateau 423. In order to open the ring members 441, an operator pivots the lever 431 upward and inward (i.e., toward the center pair of ring members 441). The lever's cam surfaces 525 engage the travel bar's shoulders 529 and linearly move the travel bar 465 toward the lever 431. This moves locking elements 511 into registration with corresponding openings 445, 447, 449 in the hinge plates, allowing the housing's spring force to pivot the hinge plates 419, 421 and open the ring members 441. The hinge plates 419, 421 include an additional opening 531 between second and third openings 445, 447 for receiving the lever's cam surfaces 525 and the travel bar's shoulders 529 through the interconnected plates 419, 421 (FIG. 17). Accordingly, there is no interference between the hinge plates 419, 421 and either the lever 431 or the travel bar 465 during operation. To close the ring members 441, the operator pivots the lever 431 downward and outward, reversing the opening action, so that the cam surfaces 525 again bear against the shoulders 529 to move the travel bar 465 away from the lever 431. As in the second embodiment, cam surfaces 513 of each locking element 511, which in this embodiment are identical to the cam surfaces 113 of the locking elements described for the alternative version of the travel bar 105 above, engage the hinge plates 419, 421 and cause them to pivot to close the ring members 441. It is understood that while in this embodiment the housing's spring force pivots the hinge plates 419, 421 for opening the ring members 441, wire form springs may alternatively be attached to the underside of hinge plates for pivoting the plates as was described for the first embodiment.

Components of the mechanism of the present invention according to the several discussed embodiments are made of a suitable rigid material, such as metal (e.g., steel). But mechanisms made of a nonmetallic material, specifically including plastic, do not depart from the scope of this invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and variations thereof is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for retaining loose-leaf pages, the mechanism comprising:

a housing having longitudinal ends;

first and second hinge plates supported by the housing for pivoting motion about a pivot axis, said pivoting motion being relative to the housing;

rings for holding loose-leaf pages, each ring including a first ring member moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings;

a travel bar movable in translation relative to both the housing and the hinge plates, said translational movement being generally lengthwise of the housing;

a locking element moveable in translation relative to both the housing and the hinge plates, the locking element producing the pivoting motion of the hinge plates when moving from a position in registration with an opening in at least one of the hinge plates to a position out of registration with said opening, the locking element producing no pivoting motion of the hinge plates when moving from the position out of registration with said opening to the position in registration with said opening; and an actuating lever pivotable relative to the housing for producing said translational movement of the travel bar, the actuating lever being free of driving engagement with the hinge plates such that the actuating lever does not contact the hinge plates during the pivoting motion of the hinge plates.

2. A ring binder mechanism as set forth in claim 1 wherein the locking element is connected to and projects from the travel bar.

3. A ring binder mechanism as set forth in claim 2 wherein the locking element is positioned relative to the hinge plates when the ring members are in the closed position to block the pivoting motion of the hinge plates that would bring the ring members to the open position.

4. A ring binder mechanism as set forth in claim 1 further comprising a spring for producing the pivoting motion of the hinge plates when the locking element moves to the position in registration with the opening in at least one of the hinge plates.

5. A ring binder mechanism as set forth in claim 4 wherein the spring is a wire form spring.

6. A ring binder mechanism as set forth in claim 1 wherein the hinge plates are supported by the housing such that an angle formed by exterior surfaces of the hinge plates never passes through 180° during the pivoting motion of the hinge plates.

7. A ring binder mechanism as set forth in claim 6 wherein the angle formed by the exterior surfaces of the hinge plates is less than 180° in all positions of the hinge plates.

8. A ring binder mechanism as set forth in claim 1 wherein the actuating lever is pivotally connected to a longitudinal end of the housing.

9. A ring binder mechanism as set forth in claim 1 in combination with a cover, the ring binder mechanism being mounted on the cover, the cover being hinged for movement to selectively cover and expose loose-leaf pages retained on the ring binder mechanism.

10. A ring binder mechanism for retaining loose-leaf pages, the mechanism comprising:

a housing having a longitudinal axis;

first and second hinge plates supported by the housing for pivoting motion about a pivot axis, said pivoting motion being relative to the housing;

rings for holding loose-leaf pages, each ring including a first ring member moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings;

a travel bar located above the hinge plates between the housing and the hinge plates, the travel bar being movable in translation relative to both the housing and the hinge plates, said translational movement being generally lengthwise of the housing;

a locking element moveable in translation relative to both the housing and the hinge plates, the locking element being in a position in registration with an opening in at least one of the hinge plates when the ring members are in the open position and in a position out of registration with said opening when the ring members are in the closed position for blocking the pivoting motion of the hinge plates; and the hinge plates being supported by the housing such that an angle formed by exterior surfaces of the hinge plates never passes through 180° during the pivoting motion of the hinge plates.

11. A ring binder mechanism as set forth in claim 10 wherein the angle formed by the exterior surfaces of the hinge plates is less than 180° in all positions of the hinge plates.

12. A ring binder mechanism as set forth in claim 10 wherein the locking element is shaped to pivot the hinge plates upon movement from the position in registration with the opening in at least one of the hinge plates to the position out of registration with the opening.

13. A ring binder mechanism as set forth in claim 12 wherein the locking element produces no pivoting motion of the hinge plates upon moving from the position out of registration with said opening to the position in registration with the opening.

14. A ring binder mechanism as set forth in claim 10 in combination with a cover, the ring binder mechanism being mounted on the cover, the cover being hinge for movement to selectively cover and expose loose-leaf pages retained on the ring binder mechanism.

15. A ring binder mechanism as set forth in claim 1 wherein the housing exerts a spring force on the hinge plates for producing the pivoting motion of the hinge plates when the locking element moves to the position in registration with the opening in at least one of the hinge plates.

16. A ring binder mechanism for retaining loose-leaf pages, the mechanism comprising:

a housing having longitudinal ends;

first and second hinge plates supported by the housing for pivoting motion about a pivot axis relative to the housing;

rings for holding loose-leaf pages, each ring including a first ring member moveable with the pivoting motion of the first hinge plate, each ring further including a second ring member, the first ring member being movable relative to the second ring member so that in a closed position the two ring members form a substantially continuous, closed loop for allowing loose-leaf pages retained by the rings to be moved along the rings from one ring member to the other, and in an open position the two ring members form a discontinuous, open loop for adding or removing loose-leaf pages from the rings;

a travel bar located between the hinge plates and the housing and movable in translation relative to both the housing and the hinge plates, said translational movement being generally lengthwise of the housing; and a locking element moveable in translation relative to both the housing and the hinge plates, the locking element being in a position in registration with an opening in at least one of the hinge plates when the ring members are in the open position and in a position out of registration with said opening when the ring members are in the closed position for blocking the pivoting motion of the hinge plates, wherein the housing exerts a spring force on the hinge plates that initiates the pivoting motion of the hinge plates when the locking element moves to said position in registration with the opening in at least one of the hinge plates.

17. A ring binder mechanism as set forth in claim 16 wherein the locking element is shaped to pivot the hinge plates upon movement from the position in registration with the opening in at least one of the hinge plates to the position out of registration with the opening.

18. A ring binder mechanism as set forth in claim 17 wherein the locking element produces no pivoting motion of the hinge plates upon moving from the position out of registration with said opening to the position in registration with the opening.

19. A ring binder mechanism as set forth in claim 16 further comprising an actuating lever pivotally connected to a longitudinal end of the housing, the pivoting movement of the lever producing the translational movement of the travel bar.

20. A ring binder mechanism as set forth in claim 16 in combination with a cover, the ring binder mechanism being mounted on the cover, the cover being hinged for movement to selectively cover and expose loose-leaf pages retained on the ring binder mechanism.

* * * * *